US012790755B2

(12) United States Patent
Luo et al.

(10) Patent No.: US 12,790,755 B2
(45) Date of Patent: Nov. 10, 2026

(54) BIOWAX POLYHYDROXYALKANOATE DISPERSIONS AS BIO-BASED BARRIER COATINGS

(71) Applicant: KEMIRA OYJ, Helsinki (FI)

(72) Inventors: Yuping Luo, Atlanta, GA (US); Yong Zou, Atlanta, GA (US); Michael Clark, Atlanta, GA (US); Louis Rosati, Atlanta, GA (US)

(73) Assignee: KEMIRA OYJ, Helsinki (FI)

( * ) Notice: Subject to any disclaimer, the term of this patent is extended or adjusted under 35 U.S.C. 154(b) by 179 days.

(21) Appl. No.: 18/619,586

(22) Filed: Mar. 28, 2024

(65) Prior Publication Data

US 2024/0344272 A1 Oct. 17, 2024

Related U.S. Application Data

(60) Provisional application No. 63/456,169, filed on Mar. 31, 2023.

(51) Int. Cl.
*D21H 19/18* (2006.01)
*D21H 19/28* (2006.01)
(Continued)

(52) U.S. Cl.
CPC ..... *D21H 19/18* (2013.01); *D21H 19/28* (2013.01); *D21H 19/34* (2013.01); *D21H 25/06* (2013.01)

(58) Field of Classification Search
CPC ..... D21H 19/18; D21H 19/28; D21H 19/34; D21H 25/06; D21H 21/16
See application file for complete search history.

(56) References Cited

U.S. PATENT DOCUMENTS 4,048,380 A * 9/1977 Blakey ..... D21H 19/60 427/362
2005/0014013 A1* 1/2005 Daniels ..... A61P 11/00 428/513

(Continued)

OTHER PUBLICATIONS

Chemical Book, (68334-00-9(TRISTEARIN) Product Description, 2014, https://web.archive.org/web/20141018213040/https://www.chemicalbook.com/ChemicalProductProperty_US_CB9110090.aspx (Year: 2014).*

(Continued)

*Primary Examiner* — Abbas Rashid
*Assistant Examiner* — Elisa H Vera
(74) *Attorney, Agent, or Firm* — Robin L. Teskin; Baker, Donelson, Bearman, Caldwell & Berkowitz PC

(57) ABSTRACT

The present invention relates to compositions and methods for forming substantially bio-based barrier coatings suitable for application on paper and board substrates, and paper and board substrates on which are applied one or more layers of such substantially bio-based barrier coatings. The inventive bio-based barrier coatings comprise a biowax emulsion comprising one or more biowaxes, such as castor oil wax, formed by hydrogenation of a bio-based oil, such as castor oil. The barrier coating composition is formed by dispersing a biowax emulsion into a polyhydroxyalkanoate (PHA) dispersion, and may be applied as a coating e.g., on paper or board, e.g., those comprised of recycled fibers, using conventional industrial methods at ambient temperatures.

20 Claims, 3 Drawing Sheets

(51) Int. Cl.
*D21H 19/34* (2006.01)
*D21H 25/06* (2006.01)

(56) References Cited

U.S. PATENT DOCUMENTS

| | | | | |
|---|---|---|---|---|
| 2006/0289138 | A1* | 12/2006 | Borsinger | C09D 191/06<br>162/172 |
| 2019/0177920 | A1* | 6/2019 | Koenig | D21H 17/37 |
| 2020/0095731 | A1* | 3/2020 | Spender | D21H 27/10 |

OTHER PUBLICATIONS

Wikipedia, microcrystalline wax, 2015 (Year: 2015).*

* cited by examiner

BIOWAX POLYHYDROXYALKANOATE DISPERSIONS AS BIO-BASED BARRIER COATINGS

RELATED APPLICATIONS

The present application claims benefit of priority to U.S. Provisional Application No. 63/456,169, filed on Mar. 31, 2023, and to Finnish Application Number 20235947 filed on Aug. 28, 2023, the contents of both of which are incorporated by reference in their entireties.

FIELD OF THE INVENTION

The present invention relates to compositions and methods for forming substantially bio-based barrier coatings e.g., for application on paper and board substrates. In particular, the disclosure provides biowax-based barrier compositions that can form barrier layers for enhancing oil, grease, and water resistance and can be applied without causing damage to the substrate.

BACKGROUND OF THE INVENTION

Various coatings can be applied on the surface of paper or board in order to improve their properties. Oil, grease, water, and water vapor barrier properties are particularly important for paper and board that are used for products for packaging purposes. Coating applied on the surface of paper or board should provide an effective barrier for leakage from the goods inside the package and/or protect the packaged goods from contamination and/or contact with the surrounding atmosphere. For packaging materials used for foodstuff and consumable liquids the barrier requirements are especially stringent.

The barrier resistance and wettability of paper or board is commonly controlled by the application of petroleum-based derivatives and polymers such as polyacrylates, polyethylene, ethylene vinyl alcohol (EVOH), polyvinylidene chloride (PVDC), petroleum waxes, and/or fluorocarbon derivatives as coatings. Coatings of petroleum-based polymer emulsions have been used in food or beverage packaging, such food packages made from paper, plates, bowls, cups, and containers. Barrier coatings based on fossil-oil or synthetic polymers dominate the current market due to low-cost and easy availability. Such coatings may be applied using conventional printing or coating techniques.

While surface hydrophobicity, water resistance, and oil/grease resistance (OGR) are improved by employing petroleum-based polymers, they have become disfavored due to limitations in fossil-oil resources, poor recyclability, and environmental concerns on generated waste with lack of biodegradation. Because packaging paper for food and beverage is often used only once, it is desirable for ecological reasons that the coating compositions for packaging be produced from sustainably sourced, renewable, bio-based materials. Additionally, consumer-based demand for sustainable and renewable bio-based paper and paperboard barrier coating products has increased dramatically in recent years. Generally, coating dispersions with greater than 50 wt % bio-content can be certified and labeled as a bio-based product in the market.

These factors have augmented the interest in alternative biopolymer films and coatings with similar properties to petroleum based coatings. There is a tendency for paper coating producers to replace fossil based chemistries with bio-based materials in their current barrier coating polymer emulsions.

As an alternative to petroleum-based derivatives, biopolymers including polysaccharides, proteins, and polyesters, and bio-based waxes (i.e., biowaxes), including hydrogenated bio-based oils and biolipids can be used to formulate new compositions for forming substantially bio-based barrier coatings for paper and board. These bio-based materials as barrier coatings for paper applications have the potential to replace current fossil-oil barrier coating materials. However, difficulties in processing of most biopolymers may arise due to hydrophilicity, crystallization behavior, high viscosity, unfavorable rheology, brittleness, and/or melt instabilities that hinder a full exploitation at industrial scale.

Biowaxes, including hydrogenated bio-based oils (vegetable oils and animal oils) have been successfully used to make bio-based coating materials for paper applications. Biowax comprising barrier coatings as described herein, when used to directly coat paper/paperboard, exhibit a marked increase in the resistance to oil, grease, and water moisture. However, most commercial biowax liquid formulations must be applied on paper surfaces at temperatures between 8° and 160° C., using wax applicators or other special equipment. When applied at elevated temperatures, biowax liquids tend to (i) destroy paper fiber strengths and (ii) cause discoloration of the paper.

There is currently an unmet need in the market for substantially bio-based barrier coatings for paper and board that have a high bio-based content (>50% of total coating solids) and can be applied using conventional paper coaters or metering size press machines under room temperature conditions without causing damage or discoloration to the paper/paperboard substrate. Making high bio-content coating dispersions remains a challenge.

The present application addresses this challenge by providing novel compositions and methods for forming substantially bio-based barrier coatings for paper and board. The invention provides biowax-based barrier compositions that can form barrier layers for enhancing oil, grease, and water resistance which can be applied without causing damage to the substrate and which deliver a sustainable bio-based barrier coating solution to potentially replace or minimize the need for conventional petroleum based coatings.

SUMMARY OF THE INVENTION

The present invention relates to compositions and methods for forming substantially bio-based barrier coatings, e.g., for application on paper and board substrates, e.g., those comprised of recycled fibers.

Biowax emulsions, polyhydroxyalkanoate (PHA) dispersions, and other additives are employed to form barrier coating compositions having long shelf life, high solids content, high bio-based content, and rheological properties that facilitate application as barrier coatings using conventional methods at room temperature. Barrier coating compositions comprising a biowax emulsion dispersed into one or more polyhydroxyalkanoates (PHA) with auxiliary additives (e.g., clay, MCC, and the like), when used to coat paper and/or board achieved excellent oil and water barrier properties including (i) greater than 50% bio-content (renewable raw material) in one coating layers, (ii) Cobb value (1 min) of single-layer coated sheets<6 g/m$^2$; and (iii) KIT value=12.

In one aspect, the present invention provides a barrier coating composition, optionally an oil barrier coating composition for usage on paper or board substrates, said barrier coating composition comprising:

(a) one or more biowax emulsions;
(b) one or more polyhydroxyalkanoates (PHA);
(c) one or more rheology modifiers; and
(d) one or more auxiliary additives.

In some exemplary embodiments said one or more biowax emulsions comprise:

(a) one or more biowaxes comprising palm oil wax, castor oil wax, soybean oil wax, fish oil wax, tallow oil wax, a plant oil wax, an animal oil wax, a blend of plant and animal oil waxes, or any combination thereof;
(b) one or more rosin sizing agents comprising fortified rosins, esterified rosins, rosin waxes, resin acid derivatives, gum rosins, wood rosins, tall oil rosins, rosin pastes, rosin-based dispersants, or any combination thereof;
(c) one or more surfactants comprising nonionic surfactants, anionic surfactants, or a combination thereof, wherein (i) said nonionic surfactants are selected from ethoxylated alcohols, including but not limited to, secondary alcohol ethoxylates, ethoxylated sorbitan esters, sorbitan esters, glycerol esters, including but not limited to, glycerol monostearate (GMS), and any combination thereof, and (ii) said anionic surfactants are selected from, fatty alcohol ether sulfates, alkyl ether sulfates, special soaps, including but not limited to, anionic long chain fatty acids, and any combination thereof;
(d) one or more microcrystalline or paraffinic waxes comprising saturated hydrocarbon waxes, paraffinic hydrocarbon waxes, isoparaffinic hydrocarbon waxes, naphthenic hydrocarbon waxes, and any mixture thereof, having a congealing point of 50-110° C., 65-100° C., 70-90° C., or 75-85° C.; and
(e) optionally, one or more long chain fatty acids comprising a carbon chain length ranging from C4-C30, C20-C30, C22-C30, or C24-C30.

In some exemplary embodiments said one or more biowaxes:

(a) comprise one or more hydrogenated bio-based oils including, but not limited to, palm oil, castor oil, soybean oil, fish oil, tallow oil, a plant oil, an animal oil, a blend of plant and animal oils, or any combination thereof, and wherein each of said hydrogenated bio-based oils has a higher melting point compared to the corresponding non-hydrogenated bio-based oil; and
(b) have a melting point of 55-98° C., 60-95° C., 65-90° C., 70-85° C., or 75-80° C.

In some exemplary embodiments according to any of the foregoing, in said one or more biowax emulsions:

(a) said one or more biowaxes comprise castor oil wax;
(b) said one or more rosin sizing agents comprise fortified rosin size;
(c) said nonionic surfactants comprise secondary alcohol ethoxylates, glycerol monostearate (GMS), or a combination thereof and said anionic surfactants comprise anionic long chain fatty acids, or a combination thereof;
(d) said one or more microcrystalline or paraffinic waxes have a congealing point of 70-90° C.; and
(e) said one or more long chain fatty acids have a carbon chain length ranging from C22-C30.

In some exemplary embodiments according to any of the foregoing said one or more biowax emulsions comprise:

(a) said one or more biowaxes in an amount ranging from 20-60 wt %, 25-55 wt %, 30-50 wt %, or 35-45 wt %;
(b) said one or more rosin sizing agents in an amount ranging from 1-12 wt %, 2-10 wt %, 3-8 wt %, or 4-6 wt %;
(c) said one or more surfactants in an amount ranging from 2-12 wt %, 4-10 wt %, or 6-8 wt %;
(d) said one or more microcrystalline or paraffinic waxes in an amount ranging from 2-10 wt %, 3-9 wt %, 4-8 wt %, or 5-7 wt %; and
(e) optionally, said one or more long chain fatty acids in an amount ranging from 0.5-6 wt %, 1-5 wt %, or 2-4 wt %.

In some exemplary embodiments according to any of the foregoing said one or more biowax emulsions comprise an inverse phase biowax emulsion formed by:

(a) combining said one or more biowaxes, said one or more rosin sizing agents, said one or more surfactants, said one or more microcrystalline or paraffinic waxes, and optionally said one or more long chain fatty acids in a reactor and heating, optionally to 70-99° C., 75-98° C., 85-95° C., or 90-95° C., to form an oil-phase;
(b) adding an amount of water, optionally hot water, optionally 70-99° C., 75-98° C., 85-95° C., or 90-95° C. water, to said oil-phase;
(c) heating to 70-99° C., 75-98° C., or 85-95° C. and then emulsifying, optionally for an amount of time ranging from 0.5-5 h, 0.5-4 h, or 1-3 h;
(d) homogenizing;
(e) cooling the resulting inverse phase emulsion to a temperature ranging from 10-35° C., 15-30° C., or 20-25° C., optionally using an ice-water bath, a cooling jacket, or a cooling core; and
(f) optionally adding a biocide.

In some exemplary embodiments according to any of the foregoing said one or more biowax emulsions, in final form comprise a total solids content ranging from 50-80 wt %, 50-70 wt %, 50-60 wt %, or 55-57 wt % and further wherein ≥50 wt % of said total solids content is bio-based.

In some exemplary embodiments according to any of the foregoing:

(a) said one or more polyhydroxyalkanoates (PHA) comprise an aqueous polyhydroxyalkanoate (PHA) dispersion comprising one or more polyhydroxyalkanoate (PHA) polymers, wherein said aqueous polyhydroxyalkanoate (PHA) dispersion has a total dry solids content ranging from 10-70 wt %, 40-60 wt %, 45-55 wt %, or 49-51 wt %,
(b) said one or more rheology modifiers comprise hydroxypropyl methylcellulose (HPMC), one or more bio-based gums, including but not limited to, pre-hydrated cellulose gums, xanthan gums, or a mixture thereof, one or more bio-based hydrocolloids, one or more polyacrylate dispersants, including but not limited to polyacrylate dispersants having a charge ranging from 70-100 mol %, 80-100 mol %, or 90-100 mol % and a molecular weight ranging from 1000-100,000 Da, 2000-80,000 Da, or 10,000-50,000 Da, or a combination thereof;
(c) said one or more auxiliary additives are selected from clay, kaolin, alumina, silica, nano-clay, nanocellulose, nano-structured cellulose, cellulose nanofibers (CNF), nano-fibrillated cellulose (NFC), bacterial nanocellulose, cellulose nanocrystals (CNC), micro-fibrillated cellulose (MFC), and microcrystalline cellulose (MCC), and any combination thereof; or
(d) any combination of (a), (b) and (c).

In some exemplary embodiments according to any of the foregoing, in said one or more auxiliary additives:

(a) said clay and/or nano-clay is formulated as an aqueous slurry having total solids of 60-80 wt %, 65-75 wt %, or 68-72 wt % prior to being dispersed into said barrier coating composition;

(b) said cellulose nanocrystals (CNC) are formulated as an aqueous slurry or a spray-dried powder prior to being dispersed into said barrier coating composition, and are optionally produced by acid hydrolysis of cellulose;

(c) said micro-fibrillated cellulose (MFC) (i) has an average particle length ranging from 20-200 μm, 50-200 μm, 100-200 μm, or 150-200 μm, (ii) has an average particle width ranging from 0.1-1 μm, 0.2-1 μm, 0.4-1 μm, or 0.6-1 μm, and (iii) is formulated as an aqueous solution having a dry content of 10-30 wt %, 15-25 wt %, or 18-22 wt % prior to formulation with said barrier coating composition;

(d) said microcrystalline cellulose (MCC) (i) has an average particle size ranging from 1-8 μm, 2-7 μm, 3-6 μm, or 4-5 μm, and (ii) is formulated as an aqueous slurry or a spray-dried powder prior to being dispersed into said barrier coating composition.

In some exemplary embodiments according to any of the foregoing:

(a) said one or more auxiliary additives comprise clay, nano-clay, micro-fibrillated cellulose (MFC), microcrystalline cellulose (MCC), cellulose nanocrystals (CNC), or a combination thereof;

(b) said one or more auxiliary additives comprise clay, nano-clay, microcrystalline cellulose (MCC), or a combination thereof;

(c) said one or more auxiliary additives comprise clay and microcrystalline cellulose MCC; or (d) said one or more auxiliary additives comprise cellulose nanocrystals CNC.

In some exemplary embodiments according to any of the foregoing said barrier coating composition comprises:

(a) said one or more biowax emulsions in an amount ranging from 30-90 wt %, 40-90 wt %, 50-90 wt %, 60-90 wt %, or preferably 70-90 wt %;

(b) said one or more polyhydroxyalkanoates (PHA) in an amount ranging from 10-70 wt %, 10-60 wt %, 10-50 wt %, 10-40 wt %, 10-35 wt %, or preferably 10-30 wt %;

(c) said one or more rheology modifiers in an amount ranging from 0.1-5 wt %, 0.1-4 wt %, or 0.1-3 wt %; and (d) said one or more auxiliary additives in an amount ranging from 0.1-10 wt %, 1-9 wt %, 1-8 wt %, 1-6 wt %, or 1-3 wt %.

In some exemplary embodiments according to any of the foregoing said barrier coating composition comprises a dispersion formed by dispersing, separately or together, said one or more biowax emulsions, said one or more rheology modifiers, and said one or more auxiliary additives into said one or more polyhydroxyalkanoates (PHA) with mechanical mixing to form said dispersion; wherein said barrier coating composition, in final form:

(a) comprises a total solids content ranging from 30-70 wt %, 40-60 wt %, 45-55 wt %, or 48-52 wt %;

(b) comprises a bio-based solids content ranging from 40-90 wt %, 45-80 wt %, 50-70 wt %, or 55-60 wt % of said total solids content;

(c) has a particle size ranging from 0.2-15 μm, 0.2-15 μm, 0.5-12 μm, 1-10 μm, 2-8 μm, 0.2-5 μm, 1-4 μm, 2-3 μm, or 2.5-3 μm; or (d) any combination of one, two, or three, four of (a) to (c).

In some exemplary embodiments according to any of the foregoing the barrier coating composition, when applied as one or more coatings to a lignocellulosic substrate, including but not limited to paper, paperboard, lightweight wrapping paper basesheets, fast food wrapping paper basesheets, molded fibers, or 100% recycled linerboard sheets, wherein said one or more coatings are formed at room temperature, 15-30° C., or 20-25° C. using a conventional paper coater, rolling-coater, or metering size press machine, followed by oven curing at 100-120° C., 105-115° C., or 108-112° C., for a suitable time, optionally 60-120 sec, 70-110 sec, 80-100 sec, or 90-95 sec wherein the application of said barrier coating composition to said lignocellulosic substrate results in one or more of the following:

(a) said barrier coating composition forms a single coat layer, a basecoat layer, a topcoat layer, a double-coating comprising a basecoat layer and a topcoat layer comprising the same barrier coating composition, a double-coating comprising a basecoat layer and a topcoat layer comprising different barrier coating compositions, or multiple coating layers;

(b) said one or more coatings provide a barrier to transmittance of one or more of oil, grease, or water, preferably oil and/or grease, into or through said lignocellulosic substrate at temperatures ranging from 5-95° C., 15-90° C., 25-85° C., or 40-60° C., wherein said barrier to transmittance is greater than or equal to one or more coatings formed in the same manner from said polyhydroxyalkanoates (PHA) alone;

(c) said one or more coatings, when applied at a coat weight of 1-30, 2-20, 3-10, or 4-8 grams per square meter (gsm), result in KIT test values (i.e., a measure of oil and grease resistance) and optionally Cobb 1 min test values (i.e., a measure of mass of water absorbed per square meter over 1 min) that are equal to or enhanced (i.e., higher KIT values and lower Cobb values) compared one or more coatings formed in the same manner from said polyhydroxyalkanoates (PHA) alone;

(d) said one or more coatings, when applied at a coat weight of 1-30, 2-20, 3-10, or 4-8 grams per square meter (gsm) displays a coat weight dependent decrease in Cobb 1 min test results; and (e) said one or more coatings, in final form, comprise a percent bio-based material of ≥50 wt %, 50-80 wt %, 50-70 wt %, 50-60 wt %, or 50-55 wt %.

In another aspect, the present invention provides a method for preparing a barrier coating composition for paper or board, optionally an oil barrier coating composition according to any of the foregoing compositions, the method comprising:

(a) forming at least one biowax emulsion;

(b) forming or providing one or more polyhydroxyalkanoates (PHA);

(c) dispersing said at least one biowax emulsion into said one or more polyhydroxyalkanoates (PHA);

(d) dispersing one or more rheology modifiers into said one or more polyhydroxyalkanoates (PHA); and (e) dispersing one or more auxiliary additives into said one or more polyhydroxyalkanoates (PHA);

wherein steps (c)-(e) are effected together or separately.

In some exemplary embodiments of the method said at least one biowax emulsion comprises:

(a) one or more biowaxes comprising palm oil wax, castor oil wax, soybean oil wax, fish oil wax, tallow oil wax, a plant oil wax, an animal oil wax, a blend of plant and animal oil waxes, or any combination thereof, wherein said one or more biowaxes (i) comprise one or more hydrogenated bio-based oils including, but not limited to, palm oil, castor oil, soybean oil, fish oil, tallow oil, a plant oil, an animal oil, a blend of plant and animal oils, or any combination thereof, wherein each of said hydrogenated bio-based oils have a higher melting point compared to the corresponding non-hydrogenated bio-based oil and (ii) has a melting point of 55-98° C., 60-95° C., 65-90° C., 70-85° C., or 75-80° C.;

(b) one or more rosin sizing agents comprising fortified rosins, esterified rosins, rosin waxes, resin acid derivatives, gum rosins, wood rosins, tall oil rosins, rosin pastes, rosin-based dispersants, or any combination thereof;

(c) one or more surfactants comprising nonionic surfactants, anionic surfactants, or a combination thereof, wherein (i) said nonionic surfactants are selected from ethoxylated alcohols, including but not limited to, secondary alcohol ethoxylates, ethoxylated sorbitan esters, sorbitan esters, glycerol esters, including but not limited to, glycerol monostearate (GMS), and any combination thereof, and (ii) said anionic surfactants are selected from, fatty alcohol ether sulfates, alkyl ether sulfates, special soaps, including but not limited to, anionic long chain fatty acids, and any combination thereof;

(d) one or more microcrystalline or paraffinic waxes comprising saturated hydrocarbon waxes, paraffinic hydrocarbon waxes, isoparaffinic hydrocarbon waxes, naphthenic hydrocarbon waxes, and any mixture thereof, having a congealing point of 50-110° C., 65-100° C., 70-90° C., or 75-85° C.; and (e) optionally, one or more long chain fatty acids comprising a carbon chain length ranging from C4-C30, C20-C30, C22-C30, or C24-C30.

In some exemplary embodiments of the method said at least one biowax emulsion comprises:

(a) said one or more biowaxes in an amount ranging from 20-60 wt %, 25-55 wt %, 30-50 wt %, or 35-45 wt %;

(b) said one or more rosin sizing agents in an amount ranging from 1-12 wt %, 2-10 wt %, 3-8 wt %, or 4-6 wt %;

(c) said one or more surfactants in an amount ranging from 2-12 wt %, 4-10 wt %, or 6-8 wt %;

(d) said one or more microcrystalline or paraffinic waxes in an amount ranging from 2-10 wt %, 3-9 wt %, 4-8 wt %, or 5-7 wt %; and (e) optionally, said one or more long chain fatty acids in an amount ranging from 0.5-6 wt %, 1-5 wt %, or 2-4 wt %, wherein said at least one biowax emulsion comprises an inverse phase biowax emulsion formed by (i) combining said one or more biowaxes, said one or more rosin sizing agents, said one or more surfactants, said one or more microcrystalline or paraffinic waxes, and optionally said one or more long chain fatty acids in a reactor and heating, optionally to 70-99° C., 75-98° C., 85-95° C., or 90-95° C., to form an oil-phase;

(ii) adding an amount of water, optionally hot water, optionally 70-99° C., 75-98° C., 85-95° C., or 90-95° C. water to said oil-phase;

(iii) heating to 70-99° C., 75-98° C., or 85-95° C. and then emulsifying, optionally for an amount of time ranging from 0.5-5 h, 0.5-4 h, or 1-3 h;

(iv) homogenizing;

(v) cooling the resulting inverse phase biowax emulsion to a temperature ranging from 10-35° C., 15-30° C., or 20-25° C., optionally by means of an ice-water bath, a cooling jacket, or a cooling core; and (vi) optionally adding a biocide.

In some exemplary embodiments of the method said at least one biowax emulsion, in final form: comprises a total solids content ranging from 50-80 wt %, 50-70 wt %, 50-60 wt %, or 55-57 wt % and further wherein ≥50 wt % of said total solids content is bio-based.

In some exemplary embodiments of the method:

(a) said one or more polyhydroxyalkanoates (PHA) comprise an aqueous polyhydroxyalkanoate (PHA) dispersion comprising one or more polyhydroxyalkanoate (PHA) polymers, wherein said aqueous polyhydroxyalkanoate (PHA) dispersion has a total dry solids content ranging from 10-70 wt %, 40-60 wt %, 45-55 wt %, or 49-51 wt %, (b) said one or more rheology modifiers comprise hydroxypropyl methylcellulose (HPMC), one or more bio-based gums, including but not limited to, pre-hydrated cellulose gums, xanthan gums, or a mixture thereof, one or more bio-based hydrocolloids, one or more polyacrylate dispersants, including but not limited to polyacrylate dispersants having a charge ranging from 70-100 mol %, 80-100 mol %, or 90-100 mol % and a molecular weight ranging from 1000-100,000 Da, 2000-80,000 Da, or 10,000-50,000 Da, or a combination thereof; and (c) said one or more auxiliary additives are selected from clay, kaolin, alumina, silica, nano-clay, nanocellulose, nano-structured cellulose, cellulose nanofibers (CNF), nano-fibrillated cellulose (NFC), bacterial nanocellulose, cellulose nanocrystals (CNC), micro-fibrillated cellulose (MFC), and microcrystalline cellulose (MCC), and any combination thereof, wherein (i) said clay and/or nano-clay is formulated as an aqueous slurry having total solids of 60-80 wt %, 65-75 wt %, or 68-72 wt % prior to being dispersed into said barrier coating composition;

(ii) said cellulose nanocrystals (CNC) are formulated as an aqueous slurry or a spray-dried powder prior to being dispersed into said barrier coating composition, and are optionally produced by acid hydrolysis of cellulose;

(iii) said micro-fibrillated cellulose (MFC) (i) has an average particle length ranging from 20-200 μm, 50-200 μm, 100-200 μm, or 150-200 μm, (ii) has an average particle width ranging from 0.1-1 μm, 0.2-1 μm, 0.4-1 μm, or 0.6-1 μm, and (iii) is formulated as an aqueous solution having a dry content of 10-30 wt %, 15-25 wt %, or 18-22 wt % prior to formulation with said barrier coating composition; and (iv) said microcrystalline cellulose (MCC) (i) has an average particle size ranging from 1-8 μm, 2-7 μm, 3-6 μm, or 4-5 μm, and (ii) is formulated as an aqueous slurry or a spray-dried powder prior to being dispersed into said barrier coating composition.

In some exemplary embodiments of the method said barrier coating composition comprises:

(a) said at least one biowax emulsion in an amount ranging from 30-90 wt %, 40-90 wt %, 50-90 wt %, 60-90 wt %, or preferably 70-90 wt %;

(b) said one or more polyhydroxyalkanoates (PHA) in an amount ranging from 10-70 wt %, 10-60 wt %, 10-50 wt %, 10-40 wt %, 10-35 wt %, or preferably 10-30 wt %;

(c) said one or more rheology modifiers in an amount ranging from 0.1-5 wt %, 0.1-4 wt %, or 0.1-3 wt %; and (d) said one or more auxiliary additives in an amount ranging from 0.1-10 wt %, 1-9 wt %, 1-8 wt %, 1-6 wt %, or 1-3 wt %, wherein said at least one biowax emulsion, said one or more rheology modifiers, and said one or more auxiliary additives are dispersed, separately or together, into said one or more polyhydroxyalkanoates (PHA) with mechanical mixing to form said barrier coating composition, wherein, in final form, said barrier coating composition (i) comprises a total solids content ranging from 30-70 wt %, 40-60 wt %, 45-55 wt %, or 48-52 wt %;

(ii) comprises a bio-based solids content ranging from 40-90 wt %, 45-80 wt %, 50-70 wt %, or 55-60 wt % of said total solids content;

(iii) has a particle size ranging from 0.2-15 μm, 0.2-15 μm, 0.5-12 μm, 1-10 μm, 2-8 μm, 0.2-5 μm, 1-4 μm, 2-3 μm, or 2.5-3 μm; or (iv) any combination of one, two, or three (i) to (iii).

In some exemplary embodiments of the method said barrier coating composition is applied as one or more coatings to a lignocellulosic substrate, including but not limited to paper, paperboard, lightweight wrapping paper basesheets, fast food wrapping paper, molded fibers, or 100% recycled linerboard sheets, wherein said one or more coatings are formed at room temperature, 15-30° C., or 20-25° C. using a conventional paper coater, rolling-coater, or metering size press machine, followed by oven curing at 100-120° C., 105-115° C., or 108-112° C., for a suitable time, optionally 60-120 sec, 70-110 sec, 80-100 sec, or 90-95 sec, and wherein application of said barrier coating composition to said lignocellulosic substrate results in one or more of the following:

(a) said barrier coating composition forms a single coat layer, a basecoat layer, a topcoat layer, a double-coating comprising a basecoat layer and a topcoat layer comprising the same barrier coating composition, a double-coating comprising a basecoat layer and a topcoat layer comprising different barrier coating compositions, or multiple coating layers;

(b) said one or more coatings provide a barrier to transmittance of one or more of oil, grease, or water, preferably oil and/or grease, into or through said lignocellulosic substrate at temperatures ranging from 5-95° C., 15-90° C., 25-85° C., or 40-60° C., wherein said barrier to transmittance is greater than or equal to one or more coatings formed in the same manner from said polyhydroxyalkanoates (PHA) alone;

(c) said one or more coatings, when applied at a coat weight of 1-30, 2-20, 3-10, or 4-8 grams per square meter (gsm), result in KIT test values (i.e., a measure of oil and grease resistance) and optionally Cobb 1 min test values (i.e., a measure of mass of water absorbed per square meter over 1 min) that are equal to or enhanced (i.e., higher KIT values and lower Cobb values) compared one or more coatings formed in the same manner from said polyhydroxyalkanoates (PHA) alone;

(d) said one or more coatings, optionally when applied at a coat weight of 1-30, 2-20, 3-10, or 4-8 grams per square meter (gsm) display a coat weight dependent decrease in Cobb 1 min test results; and (e) said one or more coatings, in final form, comprise a percent bio-based material of ≥50 wt %, 50-80 wt %, 50-70 wt %, 50-60 wt %, or 50-55 wt %.

In another aspect, the present invention provides a lignocellulosic substrate, including but not limited to paper, paperboard, lightweight wrapping paper basesheets, fast food wrapping paper, molded fibers, or 100% recycled linerboard sheets, comprising one or more coatings of a barrier coating composition according to any of the foregoing compositions, or produced by a method according to any of the foregoing methods.

In another aspect, the present invention provides a sheet-like product for use as a food service package, a beverage service package, or any package suitable for the transport and/or storage of materials comprising oil, grease, and/or water, preferably oil and/or grease, comprising:

(a) a substrate comprising lignocellulosic fibers, and having a first parallel large surface and a second parallel large surface, and (b) a coating structure comprising a barrier coating composition according to any one of the foregoing compositions applied in at least one layer to at least one of the large surfaces of the substrate, wherein said sheet-like product has (i) a KIT test value of 11-12, or 12; and (ii) optionally a Cobb 1 min value of less than 6 gsm.

In another aspect, the present invention also provides a sheet-like product for use as a food service package, a beverage service package, or any package suitable for the transport and/or storage of materials comprising oil, grease, and/or water, preferably oil and/or grease, comprising:

(a) a substrate comprising lignocellulosic fibers, and having a first parallel large surface and a second parallel large surface, and (b) a coating structure comprising a barrier coating composition prepared according to any one of the foregoing methods applied in at least one layer to at least one of the large surfaces of the substrate, wherein said sheet-like product has (i) a KIT test value of 11-12, or 12; and (ii) optionally a Cobb 1 min value of less than 6 gsm.

BRIEF DESCRIPTION OF THE DRAWINGS

The invention will be described in more detail with reference to appended drawings, described in detail below.

DETAILED DESCRIPTION OF THE INVENTION

Figure 1:
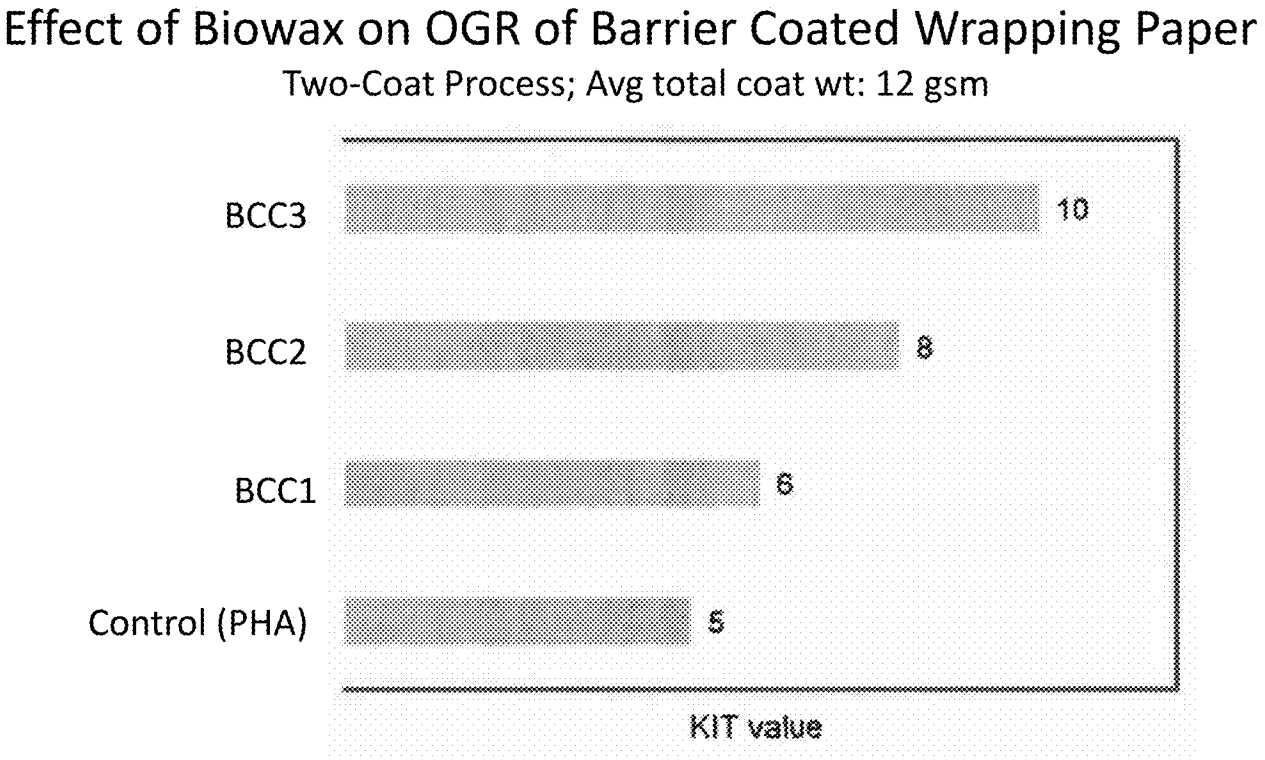
FIG. 1 provides an exemplary bar graph of KIT values indicating oil and grease resistance for barrier-coated wrapping paper basesheets coated with double-layer barrier coatings according to Example 2.

Before describing the invention, the following definitions are provided. Unless stated otherwise all terms are to be construed as they would be by a person skilled in the art.

Definitions

As used herein the singular forms "a", "and", and "the" include plural referents unless the context clearly dictates otherwise.

The term "lignocellulosic substrate" refers to refers a paper and/or paperboard product formed from plant dry matter from any source, virgin or recycled, which may be coated, printed, and/or formed into a packaging product. For example, such substrates include paper products made from pulp, such as by methods comprising forming an aqueous cellulosic papermaking furnish, draining the furnish to form a sheet, and drying the sheet. The steps of forming the papermaking furnish, draining and drying may be carried out in any conventional manner generally known in the art. The substrates may contain polymeric strengthening agents, such as wet strength and dry strength agents.

The terms "sheet-like substrates" or sheet-like products" refer to lignocellulosic substrates that may be formed into containers for use as a food service package, a beverage service package, or any package suitable for the transport and/or storage of materials comprising oil, water, and/or grease. Such sheet-like substrates, when flat, have a "top side" planar surface and a "bottom side" planar surface, which are parallel to each other. Such "top side" and "bottom side" planar surface are also referred to as a "first parallel large surface" and a "second parallel large surface". These surfaces may be coated with one or more layers, which form the basis of a barrier coating.

The term "barrier coating" refers to a layer or multiple layers applied as a coating to paper and paperboard products that impart barrier properties that impart resistance to the permeation of oil, water, and grease, and/or vapors into and through the packaging, which passage if not prevented could cause undesirable leaks and staining. Barrier coatings are often applied to the one or both surfaces of paper products to make such products useful for packaging food, beverage, raw materials, and other products. Barrier properties are useful when, for example, the packaged food product contains oil and/or grease, such as pizza or fried chicken. Such coatings should also provide the "substrate", e.g., the paper or board material used to make the packaging material, with a smooth and uniform surface finish. In some instances, the barrier coating should have other properties, such as be glueable, printable, or heat sealable, in order to close the packaging. Barrier coatings may be applied as a single coating layer of any thickness, or as multiple coating layers, including double-coatings, triple coatings, etc. The first layer applied may be referred to as the basecoat layer and the last layer may be referred to as the topcoat layer. Successive layers may be applied with or without drying and/or curing in between layer applications.

The term "barrier coating composition" refers to any composition in liquid, emulsion, dispersion, solid, or gas form that is applied to the surface of a substrate to form a barrier coating. Typically, when in liquid, emulsion, or dispersion form, the barrier coating composition preferably has a viscosity that is amenable to application via conventional paper coaters, paper rolling-coaters, or metering size press machines under room temperature conditions. The barrier coating composition viscosity may be modified as needed to suite the method that is used when added or applied to the products/substrate (e.g., paper or board).

The term "bio-based" refers to any material that is (i) directly extracted from the biomass (natural materials) such as polysaccharides, proteins, and lipids, (ii) that is synthesized from the bio-derived materials, (iii) that is a biodegradable material, or (iv) that originates from sustainable and/or renewable resources. Such materials include monomers, polymers, lipids, or oils that are directly produced and extracted from microorganisms and then subjected to further processing techniques, such as hydrogenation, hydrolysis, esterification, fermentation, or enzymatic reactions.

The term "bio-based oil" refers to any oil derived or sourced, wholly or in part, from a plant or animal, including but not limited to, palm oil, castor oil, soybean oil, fish oil, tallow oil, a plant oil, an animal oil, a blend of plant and animal oils, or any combination thereof.

The term "biowax" refers to any wax or waxy substance derived or sourced from a bio-based oils. For example, biowaxes may be formed by partial or complete hydrogenation of bio-based oils or mixtures of bio-based oils to form biowax materials that have a higher melting point compared to the corresponding non-hydrogenated bio-based oil.

The term "biowax emulsion" refers to an emulsion or mixture of immiscible liquids containing one or more biowaxes and water that have been emulsified into an inverse phase biowax emulsion. Biowax emulsions may also contain one or more rosin sizing agents, one or more surfactants, one or more microcrystalline or paraffinic waxes, or one or more long chain fatty acids, or any other material appropriate for formulation as a biowax-based barrier composition for paper or board. The components of a biowax emulsion may be added together or separately and emulsification may be achieved by any convenient means of mixing, with or without heating.

As used herein the term "substantially bio-based barrier composition" means that the "barrier coating composition" defined as above is substantially or predominantly comprised of "bio-based" materials, e.g., the composition comprises at least 50, 60, 70, 80, 90, or 95% or more weight percent of bio-based" materials as above defined, e.g., "biowaxes", "bio-based oils" as further above defined.

The term "microcrystalline wax" refers to a type of wax produced by de-oiling petrolatum, as part of the petroleum refining process, contains a relatively higher percentage of isoparaffinic (branched) hydrocarbons and naphthenic hydrocarbons compared to paraffin wax, and is characterized by the fineness of its crystals. Microcrystalline waxes generally consist of hydrocarbon waxes that predominantly comprise saturated acyclic and cyclic hydrocarbons or contains such structures as a major portion of the molecules therein. Naphthenic hydrocarbons are a type of organic compound of carbon and hydrogen that contains one or more saturated cyclic (ring) structures, or contains such structures as a major portion of the molecule. Other Naphthenic compounds are sometimes called naphthenes, cycloparaffins, or hydrogenated benzenes.

The term "long chain fatty acid" refers to a carboxylic acid with an aliphatic chain having more than 12 carbons. Typically, the number of carbons in the aliphatic chain is denoted by C#, for example a 14 carbon aliphatic chain is referred to as a C14 fatty acid. Long chain fatty acids may be a single molecule or a mixture of fatty acids with various chain lengths. They may be linear or branched, saturated or unsaturated, or a combination thereof and may also contain mixtures of acids, anhydrides and esters.

The term "polyhydroxyalkanoate (PHA) dispersion" refers to a dispersion of polyhydroxyalkanoates (PHA) or polyhydroxyalkanoate (PHA) copolymers into which is blended or dispersed various other components of a barrier coating material. For the present invention, PHA dispersions serve as a material into which a barrier coating material, such as a biowax emulsion, is dispersed or blended in order to prevent the coating material from penetrating into a paper or board substrate. PHA allows for a barrier material or barrier coating composition to be applied as a barrier coating to a paper or board substrate without penetrating into the pores of the paper or board. Dispersion of a barrier material into PHA also allows for the barrier coating to be applied one surface of a sheet-like paper or board substrate without bleeding or soaking through to the opposite side.

The term "rheology modifier" refer to any substance that can alter the rheological properties (e.g., resistance to deformation and flow) of a material. They are added to formulations to increase or decrease viscosity and to control a finished the properties and characteristics of a liquid composition in a desired manner.

The term "rosin sizing agent" refers to one or more alkali-treated rosins used as a dry powder or emulsion to surface-size paper products. Rosin size is often added to paper or board in the presence of aluminum species, and is used to increase barrier properties to water, moisture, and water vapor.

The term "fortified rosin" refers to a major component of most rosin size products, produced by reacting the levopimeric acid component of rosin with maleic anhydride. Fortified rosin sizing agent is produced by the reaction with gum rosin and fumaric acid or maleic anhydride under suitable conditions. This is Diels-alder adduct which acts as a very effective sizing agent. The Diels-Alder adduct contains extra carboxyl groups and produces more proficient sizing response than the unreacted resin acids. It is common that the rosin which is extract from tall oil is fortified with fumaric acid. In this case some of the abietic acid and related compounds are converted into tricarboxylic species.

The term "oil and grease resistance" or "OGR" refers to the ability to prevent wicking or flow of hydrophobic liquids into and across the surface of a paper or board. For example, higher OGR is achieved by rendering the surface of a paper or board substrate more lipophobic by adding a barrier coating.

The term "water resistance" refers to the ability to prevent wicking or flow of aqueous liquids into and across the surface of a paper or board. For example, higher water resistance is achieved by rendering the surface of a paper or board substrate more hydrophobic by adding a barrier coating.

The terms "dispersion" or "aqueous dispersion" generally refer to a heterogeneous mixture of a fluid (e.g., water) that contains solid particles, wherein the solid particles forms a phase separated mixture in which one substance of macroscopically or microscopically dispersed insoluble or soluble particles is suspended throughout another substance, typically a liquid substance. A dispersion has a dispersed phase (the suspended particles) and a continuous phase (the medium of suspension) that arise by phase separation. Macroscopic particles typically separate and settle quickly, while colloids typically do not completely settle or take a long time to settle completely into two separated layers.

The term "liquid polymer" refers to a combination of at least one polymer and a liquid, typically an aqueous liquid. The polymer in a may be thoroughly dissolved or may be a partially dissolved suspension, dispersion, or slurry. An "aqueous polymer mixture" or "hydrated polymer composition" refers to a combination of at least one polymer and an aqueous liquid. When a dry polymer is combined with an aqueous liquid, the polymer is initially partially hydrated at the polymer-water interface. Polymers do not dissolve instantaneously in aqueous or non-aqueous solvents. Dissolution is controlled by either the disentanglement of the polymer chains or by the diffusion of the chains through a boundary layer adjacent to the polymer-solvent interface. After thorough mixing, the polymer may become fully hydrated, at which point the wetting process is complete and the polymer may be either partially dissolved or fully dissolved, depending on the nature and composition of the polymer and solvent.

The terms "polymer" or "polymeric additives" and similar terms are used in their ordinary sense as understood by one skilled in the art, and thus may be used herein to refer to or describe a large molecule (or group of such molecules) that may comprise recurring units. Polymers may be formed in various ways, including by polymerizing monomers and/or by chemically modifying one or more recurring units of a precursor polymer. Unless otherwise specified, a polymer may comprise a "homopolymer" that may comprise substantially identical recurring units that may be formed by, for example, polymerizing, a particular monomer. Unless otherwise specified, a polymer may also comprise a "copolymer" that may comprise two or more different recurring units that may be formed by, for example, copolymerizing, two or more different monomers, and/or by chemically modifying one or more recurring units of a precursor polymer. Unless otherwise specified, a polymer or copolymer may also comprise a "terpolymer" which generally refers to a polymer that comprises three or more different recurring units. Any one of the one or more polymers discussed herein may be used in any applicable process, for example, as a flocculant.

As used herein, "inverse phase biowax emulsion" refers to a liquid composition of biowax, which is first formulated into an oil-continuous phase containing a discontinuous aqueous phase dispersed in the oil phase (e.g., hydrophobic liquid), to which is then added an aqueous solution (e.g., water) so that the biowax composition becomes a substantially aqueous-continuous phase and the hydrophobic liquid phase becomes a dispersed, discontinuous phase. The inversion point can be characterized as the point at which the viscosity of the inverted polymer solution has substantially reached its maximum under a given set of conditions. In practice, this may be determined for example by measuring viscosity of the composition periodically over time and generally when at least three consecutive measurements are within the standard of error for the measurement, then the solution is considered inverted. In an embodiment of the invention, an inverse phase biowax emulsion is formed by combining biowax, rosin size, surfactants, microcrystalline or paraffinic waxes, optional long chain fatty acid, and organic base and heating to 90-95° C. to form an oil-continuous phase. To this is added an amount of hot water. The mixture was emulsified at 75-98° C. and then homogenized and cooled to form the inverse phase biowax emulsion having a substantially aqueous-continuous phase.

As used herein, the term "polyhydroxyalkanoates (PHA)" refers to a collection of natural, thermoplastic polyesters produced in nature by numerous microorganisms, including through bacterial fermentation of sugars or lipids. More than 150 different monomers can be combined within this family to give materials with extremely different properties. Commercially available PHA compositions include poly-(R)-3-hydroxybutyrate (PHB) and poly-(R)-3-hydroxybutyrate-co-(R)-3-hydroxyvalerate (PHBV), which represent only a small component of the property sets available to the PHAS. In general, PHA materials contain one or more units, for example between 10 and 1,000,000, of the following formula:

$$—OCR^1R^2(CR^3R^4)_nCO—;$$

wherein n is an integer, and wherein $R^1$, $R^2$, $R^3$, and $R^4$ independently can be hydrocarbon radicals including long chain hydrocarbon radicals, halo- and hydroxy-substituted radicals, hydroxy radicals, halogen radicals, nitrogen-substituted radicals, oxygen-substituted radicals, and/or hydrogen atoms. As used herein, the formula-$(CR^3R^4)_n$—, is defined as including the following formulas:

$$—CR^3R^4— \text{ (where n=1);}$$

$$—CR^3R^4CR^{3'}R^{4'}— \text{ (where n=2); and}$$

$$—CR^3R^4CR^{3'}R^{4'}CR^{3''}R^{4''}— \text{ (where n=3)}$$

These units may be the same in a polyhydroxyalkanoate homopolymer, or be different units, as for example in a polyhydroxyalkanoate copolymer or polyhydroxyalkanoate terpolymer. The polymers typically have a molecular weight over 300 Da, for example between 300 and 108 Da. For the present invention, polyhydroxyalkanoates are formulated as aqueous dispersions; however, polyhydroxyalkanoates may be formulated for use as solid or liquid polymers, as polymeric mixtures, as aqueous dispersions, as aqueous suspensions, as inverse phase emulsions, as inverted polymers, or by any application-specific method known in the art.

As used herein the term "polyhydroxyalkanoate (PHA) copolymer" refers to a polymer comprising a polyhydroxyalkanoate monomer and one or more comonomers. The comonomer may be anionic, cationic, or non-ionic.

As used herein, "emulsion polymer" generally refers to inverse emulsions (water-in-oil) in which water droplets containing the polymer are suspended in an oil phase, also termed a hydrophobic phase.

As used herein, "nonionic monomer" refers to a monomer which possesses a net charge of zero in aqueous solution. Non-limiting examples of nonionic monomers include, acrylamide, N-alkylacrylamides, N,N-dialkylacrylamides, methacrylamide, N-vinylmethylacetamide or formamide, vinyl acetate, vinyl pyrrolidone, alkyl methacrylates, acrylonitrile, N-vinylpyrrolidone other acrylic (or other ethylenically unsaturated) ester or other water insoluble vinyl monomers such as styrene or acrylonitrile.

As used herein, "anionic monomer" refers to a monomer which possesses a negative charge in aqueous solution. Non-limiting representative anionic monomers include acrylic acid, sodium acrylate, ammonium acrylate, methacrylic acid, 2-acrylamido-2-methylpropanesulfonic acid (AMPS), vinyl sulfonic acid, styrene sulfonic acid, maleic acid, sulfopropyl acrylate or methacrylate or other water-soluble forms of these or other polymerizable carboxylic or sulphonic acids, sulfomethylated acrylamide, allyl sulfonate, itaconic acid, acrylamidomethylbutanoic acid, fumaric acid, vinylphosphonic acid, allylphosphonic acid, phosphonomethylated acrylamide, methacrylate, itaconate, 2-acrylamido 2-methyl propane sulphonate, sulfoalkyl (meth)acrylic acids, sulfonated styrenes, unsaturated dicarboxylic acids, sulfoalkyl(meth)acrylamides, vinyl acetate, n-vinylformamide, n-vinylacetamide, n-vinylcaprolactam, n-vinylimidazole, n-vinylpyridine, n-vinylpyrolidone, acrylamidopropyltrimonium chloride, salts of said acids and the like, or another anionic ethylenically unsaturated compound.

As used herein, "micro-fibrillated cellulose" and "MFC" refer to a form of cellulose (i.e., polymer made of repeating units of glucose) obtained through a fibrillation process of cellulose fibers. Using mechanical shearing, the cellulose fibers are separated into a three dimensional network of microfibrils having a large surface area. The obtained fibrils are much smaller in diameter compared to the original fibers, and can form a network or a web-like structure. MFC may be obtained from any convenience cellulose source, including but not limited to parenchymal (non-wood) cellulose, sugar beet cellulose, wood-based cellulose, and preferably from any plant or vegetable based cellulose source.

DESCRIPTION OF THE INVENTION

The present invention relates to compositions and methods for forming substantially bio-based barrier coatings, e.g., for application on paper and board substrates, e.g., those comprised of recycled fiber materials. The inventors have provided novel compositions and methods for forming substantially bio-based barrier coatings for paper and board. The invention provides biowax-based barrier compositions that can form barrier layers for enhancing oil, grease, and water resistance and can be applied without causing damage to the substrate and which deliver a sustainable bio-based barrier coating solution to potentially replace or minimize the need for petroleum based coatings.

A packaging material should have the necessary barrier properties against water, water vapor, gases/air and grease/oils depending on the end use application, with the aim to protect the material from ambient environment or prevent the loss of flavors, fragrance, and moisture from food products. Any single material layer used in the packaging is able to provide a barrier against water, or water vapor, or gas, or grease, or combinations of maximum two or three properties, but it rarely provides full protection against all four properties. Application of multiple barrier layers is often necessary.

Herein, biowax emulsions, polyhydroxyalkanoate (PHA) dispersions, and other additives are employed to form barrier coating compositions having long shelf life, high solids content, high bio-based content, and rheological properties that facilitate application as barrier coatings using conventional methods at room temperature. Barrier coating compositions comprising a biowax emulsion dispersed into one or more polyhydroxyalkanoates (PHA) with one or more auxiliary additives (e.g., clay, MCC, and the like), when used to coat paper and/or board achieved excellent oil and water barrier properties including (i) greater than 50% bio-content (renewable raw material) in multiple coating layers, (ii) Cobb value (1 min) of two-layer coated sheets<6 $g/m^2$; and (iii) KIT value=12, which are ideal for many packaging material applications.

In exemplary embodiments, one or more surfactants are added to the barrier coating composition which are capable of stabilizing water-in-oil emulsions. Surfactants, among other things, lower the interfacial tension between the water and the water-immiscible liquid in the liquid polymer composition, so as to facilitate the formation of a water-in-oil polymer emulsion. Exemplary surfactants include, but are not limited to, sorbitan esters, in particular sorbitan monoesters with C12-C18-groups such as sorbitan monolaurate, sorbitan monopalmitate, sorbitan monostearate, sorbitan monooleate, sorbitan esters with more than one ester group such as sorbitan tristearate, sorbitan trioleate, ethoxylated fatty alcohols with 1 to 4 ethyleneoxy groups, e.g. polyoxyethylene (4) dodecylether ether, polyoxyethylene (2) hexadecyl ether, or polyoxyethylene (2) oleyl ether. Other exemplary non-limiting surfactants include the sorbitan esters, phthalic esters, fatty acid glycerides, glycerine esters, as well as the ethoxylated versions of the above. Examples of such compounds include sorbitan monooleate, the reaction product of oleic acid with isopropanolamide, hexadecyl sodium phthalate, decyl sodium phthalate, sorbitan stearate, ricinoleic acid, hydrogenated ricinoleic acid, glyceride monoester of lauric acid, glyceride monoester of stearic acid, glycerol diester of oleic acid, glycerol triester of 12-hydroxystearic acid, glycerol triester of ricinoleic acid, and the ethoxylated versions thereof containing 1 to 10 moles of ethylene oxide per mole of the basic emulsifier. Examples of emulsifying surfactants also include modified polyester surfactants, anhydride substituted ethylene copolymers, N,N-dialkanol substituted fatty amides, and tallow amine ethoxylates. Furthermore, one or more surfactants may comprise nonionic surfactants, anionic surfactants, or a combination thereof, wherein (i) said nonionic surfactants are selected from ethoxylated alcohols, including but not limited to, TERGITOL™ 15-S-40, ethoxylated sorbitan esters, sorbitan esters, glycerol esters, including but not limited to, glycerol monostearate (GMS), and any combination thereof, and (ii) said anionic surfactants may be selected from, fatty alcohol ether sulfates, alkyl ether sulfates, special soaps, including but not limited to, anionic long chain fatty acids and Hystrene 8522 (C22 FA), and any combination thereof;

In exemplary embodiments, auxiliary additives such as clay, nano-clay, cellulose nanocrystals (CNC) and/or microcrystalline cellulose (MCC) are added to barrier coating compositions and applied the basecoat to increase the natural material content in barrier coating. Clay at a low dosage range also has the ability of stabilizing final barrier coating dispersions. Previous studies have demonstrated the effectiveness of nano-clay in improving barrier performance through the tortuosity effect. Hi aspect ratio clays (e.g., aspect ratio=5000) give a good barrier at low filler levels. Great barrier properties can also be achieved by combined use of nano-clay and MCC in coating formulations. Microcrystalline cellulose (MCC) is commercially used as a texturizer, an anticaking agent, a fat substitute, an emulsifier and an extender in food production. MCC dry powder compacts well and has high binding capability. The auxiliary additives of MCC and nano-clay at low dosage levels (total content up to 10 wt %) further increase the oil resistance of biowax. Nanocelluloses have exceptional barrier properties, especially air resistance and grease/oil resistance. Cellulose nanocrystals (CNC), generally produced by acid hydrolysis of cellulose can be available in a spray-dried powder form. The use of CNC may extend oil barrier properties for PHA based barrier coating dispersions.

It has been surprisingly found that the addition of MCC and nano-clay greatly improved the OGR and water barrier performance of the biowax coating and CNC further increased the water barrier performance. This proved to be a surprising method to improve both bio-content and the barrier properties of paper through the optimization barrier coating formulations.

Barrier Coating Compositions and Methods

In one aspect, the present invention provides a barrier coating composition, optionally an oil barrier coating composition for usage on paper or board substrates, said barrier coating composition comprising:

(a) one or more biowax emulsions; (b) one or more polyhydroxyalkanoates (PHA); (c) one or more rheology modifiers; and (d) one or more auxiliary additives.

In another aspect, the present invention provides a barrier coating composition for paper or board, said barrier coating composition comprising:

(a) one or more biowax emulsions comprising a preformed inverse phase biowax emulsion comprising at least one or more biowaxes, water, one or more rosin sizing agents, one or more surfactants, one or more microcrystalline or paraffinic waxes, and optionally, one or more long chain fatty acids, wherein the inverse phase biowax emulsion is pre-formulated separately prior to addition to the barrier coating composition; (b) one or more polyhydroxyalkanoates (PHA); (c) one or more rheology modifiers; and (d) one or more auxiliary additives.

In another aspect, the present invention provides a barrier coating composition for paper or board, said barrier coating composition comprising: (a) one or more biowax emulsions; (b) one or more polyhydroxyalkanoates (PHA); (c) one or more rheology modifiers; and (d) one or more auxiliary additives, wherein said one or more biowax emulsions comprise:

(i) one or more biowaxes comprising palm oil wax, castor oil wax, soybean oil wax, fish oil wax, tallow oil wax, a plant oil wax, an animal oil wax, a blend of plant and animal oil waxes, or any combination thereof;

(ii) one or more rosin sizing agents comprising fortified rosins, esterified rosins, rosin waxes, resin acid derivatives, gum rosins, wood rosins, tall oil rosins, rosin pastes, rosin-based dispersants, or any combination thereof;

(iii) one or more surfactants comprising nonionic surfactants, anionic surfactants, or a combination thereof, wherein (i) said nonionic surfactants are selected from ethoxylated alcohols, including but not limited to, secondary alcohol ethoxylates, ethoxylated sorbitan esters, sorbitan esters, glycerol esters, including but not limited to, glycerol monostearate (GMS), and any combination thereof, and (ii) said anionic surfactants are selected from, fatty alcohol ether sulfates, alkyl ether sulfates, special soaps, including but not limited to, anionic long chain fatty acids, and any combination thereof;

(iv) one or more microcrystalline or paraffinic waxes comprising saturated hydrocarbon waxes, paraffinic hydrocarbon waxes, isoparaffinic hydrocarbon waxes, naphthenic hydrocarbon waxes, and any mixture thereof, having a congealing point of 50-110° C., 65-100° C., 70-90° C., or 75-85° C.; and (v) optionally, one or more long chain fatty acids comprising a carbon chain length ranging from C4-C30, C20-C30, C22-C30, or C24-C30.

Biowax Emulsions

In some embodiments the one or more biowax emulsions comprise at least one or more biowaxes, one or more rosin sizing agents, one or more surfactants, one or more microcrystalline or paraffinic waxes, and optionally one or more long chain fatty acids.

In some exemplary embodiments said one or more biowax emulsions comprise:

(a) one or more biowaxes selected from the group consisting of palm oil wax, castor oil wax, soybean oil wax, fish oil wax, tallow oil wax, a plant oil wax, an animal oil wax, a blend of plant and animal oil waxes, or any combination thereof;

(b) one or more rosin sizing agents, including but not limited to, fortified rosins, esterified rosins, rosin waxes, resin acid derivatives, gum rosins, wood rosins, tall oil rosins, rosin pastes, rosin-based dispersants, or any combination thereof;

(c) one or more surfactants comprising nonionic surfactants, anionic surfactants, or a combination thereof, wherein (i) said nonionic surfactants are selected from ethoxylated alcohols, including but not limited to, secondary alcohol ethoxylates, ethoxylated sorbitan esters, sorbitan esters, glycerol esters, including but not limited to, glycerol monostearate (GMS), and any combination thereof, and (ii) said anionic surfactants are selected from, fatty alcohol ether sulfates, alkyl ether sulfates, special soaps, including but not limited to, anionic long chain fatty acids, and any combination thereof;

(d) one or more microcrystalline or paraffinic waxes, including but not limited to saturated hydrocarbon waxes, paraffinic hydrocarbon waxes, isoparaffinic hydrocarbon waxes, naphthenic hydrocarbon waxes, and any mixture thereof, having a congealing point of 50-110° C., 65-100° C., 70-90° C., or 75-85° C.; and (e) optionally, one or more long chain fatty acids having a carbon chain length ranging from C4-C30, C20-C30, C22-C30, or C24-C30.

In some embodiments the one or more biowax emulsions comprise a W/O emulsion (water-in-oil), an invert emulsion (O/W, oil-in-water), a W/O emulsion that has been subjected to phase inversion to form an invert emulsion, or an invert emulsion that has been subjected to phase inversion to form a W/O emulsion, or an inverse phase biowax emulsion.

In some embodiments the one or more biowax emulsions comprise a pre-formed inverse phase biowax emulsion, which is pre-formulated by (a) combining at least one or more biowaxes, one or more rosin sizing agents, one or more surfactants, one or more microcrystalline or paraffinic waxes, and optionally one or more long chain fatty acids in a reactor and heating to a temperature ranging from 70-99° C., 75-98° C., 85-95° C., or 90-95° C. to form an oil-phase; (b) adding an amount of water, optionally hot water, optionally 70-99° C., 75-98° C., or 85-95° C. water to said oil-phase; (c) emulsifying at 70-99° C., 75-98° C., or 85-95° C., optionally for an amount of time ranging from 0.5-5 h, 0.5-4 h, or 1-3 h; (d) homogenizing; (e) cooling the resulting inverse phase biowax emulsion to a temperature ranging from 10-35° C., 15-30° C., or 20-25° C.; and (f) optionally adding a biocide.

In some embodiments, the one or more biowax emulsions comprise a pre-formed inverse phase biowax emulsion, which is pre-formulated separately prior to addition to the barrier coating composition by dispersing said inverse phase biowax emulsion into one or more polyhydroxyalkanoates (PHA), one or more rheology modifiers, and/or one or more auxiliary additives.

In some embodiments, the one or more biowax emulsions comprise a pre-formed inverse phase biowax emulsion, which is pre-formulated separately prior to addition to the barrier coating composition, preferably by dispersing said inverse phase biowax emulsion into one or more polyhydroxyalkanoates (PHA), prior to, during, or after addition of the rheology modifiers and/or auxiliary additives.

In some preferred embodiments, the one or more biowax emulsions comprise a pre-formed inverse phase biowax emulsion, which is pre-formulated separately prior to addition to the barrier coating composition, preferably by dispersing the inverse phase biowax emulsion into one or more polyhydroxyalkanoates (PHA), prior to addition of the optional rheology modifiers and/or optional auxiliary additives.

In some embodiments, the pre-formed inverse phase biowax emulsion is pre-formulated separately and comprises a total solids content ranging from 50-80 wt %, 50-70 wt %, 50-60 wt %, or 55-57 wt % and further wherein ≥50 wt % of said total solids content is bio-based.

In some embodiments, the pre-formed inverse phase biowax emulsion is pre-formulated separately and then added to (i) one or more polyhydroxyalkanoates (PHA), (ii) the one or more auxiliary additives, and/or (iii) the one or more rheology modifiers, thereby forming a barrier coating composition having improved solids content (e.g., 30-70 wt %, 40-60 wt %, 45-55 wt %, or 48-52 wt %), an improved bio-based solids content (e.g., 40-90 wt %, 45-80 wt %, 50-70 wt %, or 55-60 wt %), and/or improved particle size (e.g., 0.2-15 μm, 0.2-15 μm, 0.5-12 μm, 1-10 μm, 2-8 μm, 0.2-5 μm, 1-4 μm, 2-3 μm, or 2.5-3 μm) of the final barrier coating composition compared to the same barrier coating composition formed without pre-formulating the one or more biowaxes as an inverse phase biowax emulsion.

In some exemplary embodiments said one or more biowaxes:

(a) comprise one or more hydrogenated bio-based oils including, but not limited to, palm oil, castor oil, soybean oil, fish oil, tallow oil, a plant oil, an animal oil, a blend of plant and animal oils, or any combination thereof, and wherein each of said hydrogenated bio-based oils has a higher melting point compared to the corresponding non-hydrogenated bio-based oil; and (b) have a melting point of 55-98° C., 60-95° C., 65-90° C., 70-85° C., or 75-80° C.

In some exemplary embodiments according to any of the foregoing, in said one or more biowax emulsions:

(a) said one or more biowaxes comprise castor oil wax; (b) said one or more rosin sizing agents comprise fortified rosin size; (c) said nonionic surfactants comprise secondary alcohol ethoxylates, glycerol monostearate (GMS), or a combination thereof and said anionic surfactants comprise anionic long chain fatty acids, or a combination thereof; (d) said one or more microcrystalline or paraffinic waxes have a congealing point of 70-90° C.; and (e) said one or more long chain fatty acids have a carbon chain length ranging from C22-C30.

In some exemplary embodiments according to any of the foregoing said one or more biowax emulsions comprise:

(a) said one or more biowaxes in an amount ranging from 20-60 wt %, 25-55 wt %, 30-50 wt %, or 35-45 wt %; (b) said one or more rosin sizing agents in an amount ranging from 1-12 wt %, 2-10 wt %, 3-8 wt %, or 4-6 wt %; (c) said one or more surfactants in an amount ranging from 2-12 wt %, 4-10 wt %, or 6-8 wt %; (d) said one or more microcrystalline or paraffinic waxes in an amount ranging from 2-10 wt %, 3-9 wt %, 4-8 wt %, or 5-7 wt %; and (e) optionally, said one or more long chain fatty acids in an amount ranging from 0.5-6 wt %, 1-5 wt %, or 2-4 wt %.

In some exemplary embodiments according to any of the foregoing said one or more biowax emulsions comprise an inverse phase biowax emulsion formed by:

(a) combining said one or more biowaxes, said one or more rosin sizing agents, said one or more surfactants, said one or more microcrystalline or paraffinic waxes, and optionally said one or more long chain fatty acids in a reactor and heating, optionally to 70-99° C., 75-98° C., 85-95° C., or 90-95° C., to form an oil-phase;

(b) adding an amount of water, optionally hot water, optionally 70-99° C., 75-98° C., 85-95° C., or 90-95° C. water, to said oil-phase;

(c) heating to 70-99° C., 75-98° C., or 85-95° C. and then emulsifying, optionally for an amount of time ranging from 0.5-5 h, 0.5-4 h, or 1-3 h;

(d) homogenizing;

(e) cooling the resulting inverse phase emulsion to a temperature ranging from 10-35° C., 15-30° C., or 20-25° C., optionally using an ice-water bath, a cooling jacket, or a cooling core; and (f) optionally adding a biocide.

In some exemplary embodiments according to any of the foregoing said one or more biowax emulsions, in final form, comprise a total solids content ranging from 50-80 wt %, 50-70 wt %, 50-60 wt %, or 55-57 wt % and further wherein ≥50 wt % of said total solids content is bio-based.

In some embodiments said one or more biowax emulsions have a final bulk viscosity ranging from 1000-2400 cPs, 1400-1800 cPs, 1500-1700 cPs, 1550-1650 cPs, or 1590-1610 cPs.

Polyhydroxyalkanoates (PHA)

In some exemplary embodiments according to any of the foregoing: said one or more polyhydroxyalkanoates (PHA) comprise an aqueous polyhydroxyalkanoate (PHA) dispersion comprising one or more polyhydroxyalkanoate (PHA) polymers, wherein said aqueous polyhydroxyalkanoate (PHA) dispersion has a total dry solids content ranging from 10-70 wt %, 40-60 wt %, 45-55 wt %, or 49-51 wt %.

In some exemplary embodiments said barrier coating composition comprises said one or more polyhydroxyalkanoates (PHA) in an amount ranging from 10-70 wt %, 10-60 wt %, 10-50 wt %, 10-40 wt %, 10-35 wt %, or preferably 10-30 wt %;

In some exemplary embodiments said one or more biowax emulsions, rheology modifiers, and auxiliary additives are dispersed, together or separately in any order, directly into said one or more polyhydroxyalkanoates (PHA) to form the barrier coating composition.

Rheology Modifiers

In some exemplary embodiments according to any of the foregoing said one or more rheology modifiers comprise hydroxypropyl methylcellulose (HPMC), one or more bio-based gums, including but not limited to, pre-hydrated cellulose gums, xanthan gums, or a mixture thereof, one or more bio-based hydrocolloids, one or more polyacrylate dispersants, including but not limited to polyacrylate dispersants having a charge ranging from 70-100 mol %, 80-100 mol %, or 90-100 mol % and a molecular weight ranging from 1000-100,000 Da, 2000-80,000 Da, or 10,000-50,000 Da, or a combination thereof.

In some preferred embodiments, said one or more rheology modifiers comprise hydroxypropyl methylcellulose (HPMC), one or more polyacrylate dispersants, including but not limited to polyacrylate dispersants having a charge ranging from 70-100 mol %, 80-100 mol %, or 90-100 mol % and a molecular weight ranging from 1000-100,000 Da, 2000-80,000 Da, or 10,000-50,000 Da, or a combination thereof.

In some exemplary embodiments said barrier coating composition comprises said one or more rheology modifiers in an amount ranging from 0.1-5 wt %, 0.1-4 wt %, or 0.1-3 wt %. In some embodiments, the dosage of said one or more rheology modifiers is modified to achieve a final bulk viscosity of the barrier coating composition of 40-2000 cPs or 150-800 cPs.

In some exemplary embodiments said one or more rheology modifiers are dispersed directly into the barrier coating composition prior to, during, or after addition of the biowax emulsions, polyhydroxyalkanoates (PHA), and/or auxiliary additives. In some exemplary embodiments said one or more rheology modifiers are dispersed directly into said one or more polyhydroxyalkanoates (PHA), separately or together with the biowax emulsions and/or auxiliary additives.

Auxiliary Additives

In some exemplary embodiments according to any of the foregoing said one or more auxiliary additives are selected from clay, kaolin, alumina, silica, nano-clay, nanocellulose, nano-structured cellulose, cellulose nanofibers (CNF), nanofibrillated cellulose (NFC), bacterial nanocellulose, cellulose nanocrystals (CNC), micro-fibrillated cellulose (MFC), and microcrystalline cellulose (MCC), and any combination thereof.

In some exemplary embodiments according to any of the foregoing (a) said one or more auxiliary additives comprise clay, nano-clay, micro-fibrillated cellulose (MFC), microcrystalline cellulose (MCC), cellulose nanocrystals (CNC), or a combination thereof; (b) said one or more auxiliary additives comprise clay, nano-clay, microcrystalline cellulose (MCC), or a combination thereof; (c) said one or more auxiliary additives comprise clay and microcrystalline cellulose MCC; or (d) said one or more auxiliary additives comprise cellulose nanocrystals CNC.

In preferred embodiments said one or more auxiliary additives comprises clay, nano-clay, microcrystalline cellulose (MCC), cellulose nanocrystals (CNC), or a combination thereof.

In some exemplary embodiments according to any of the foregoing, in said one or more auxiliary additives: (a) said clay and/or nano-clay is formulated as an aqueous slurry having total solids of 60-80 wt %, 65-75 wt %, or 68-72 wt % prior to being dispersed into said barrier coating composition; (b) said cellulose nanocrystals (CNC) are formulated as an aqueous slurry or a spray-dried powder prior to being dispersed into said barrier coating composition, and are optionally produced by acid hydrolysis of cellulose; (c) said micro-fibrillated cellulose (MFC) (i) has an average particle length ranging from 20-200 μm, 50-200 μm, 100-200 μm, or 150-200 μm, (ii) has an average particle width ranging from 0.1-1 μm, 0.2-1 μm, 0.4-1 μm, or 0.6-1 μm, and (iii) is formulated as an aqueous solution having a dry content of 10-30 wt %, 15-25 wt %, or 18-22 wt % prior to formulation with said barrier coating composition; (d) said microcrystalline cellulose (MCC) (i) has an average particle size ranging from 1-8 μm, 2-7 μm, 3-6 μm, or 4-5 μm, and (ii) is formulated as an aqueous slurry or a spray-dried powder prior to being dispersed into said barrier coating composition.

In some exemplary embodiments said one or more auxiliary additives are dispersed directly into the barrier coating composition prior to, during, or after addition of the biowax emulsions, polyhydroxyalkanoates (PHA), and/or rheology modifiers. In some exemplary embodiments said one or more auxiliary additives are dispersed directly into said one or more polyacrylate carriers separately or together with the biowax emulsions and/or rheology modifiers.

In some exemplary embodiments according to any of the foregoing said barrier coating composition comprises:

(a) said one or more biowax emulsions in an amount ranging from 30-90 wt %, 40-90 wt %, 50-90 wt %, 60-90 wt %, or preferably 70-90 wt %; (b) said one or more polyhydroxyalkanoates (PHA) in an amount ranging from 10-70 wt %, 10-60 wt %, 10-50 wt %, 10-40 wt %, 10-35 wt %, or preferably 10-30 wt %; (c) said one or more rheology modifiers in an amount ranging from 0.1-5 wt %, 0.1-4 wt %, or 0.1-3 wt %; and (d) said one or more auxiliary additives in an amount ranging from 0.1-10 wt %, 1-9 wt %, 1-8 wt %, 1-6 wt %, or 1-3 wt %.

In some embodiments according to any of the foregoing said barrier coating composition comprises a dispersion formed by dispersing, separately or together, said one or more biowax emulsions, said one or more rheology modifiers, and said one or more auxiliary additives into said one or more polyhydroxyalkanoates (PHA) with mechanical mixing to form said dispersion; wherein said barrier coating composition, in final form:

(a) comprises a total solids content ranging from 30-70 wt %, 40-60 wt %, 45-55 wt %, or 48-52 wt %; (b) comprises a bio-based solids content ranging from 40-90 wt %, 45-80 wt %, 50-70 wt %, or 55-60 wt % of said total solids content; (c) has a particle size ranging from 0.2-15 μm, 0.2-15 μm, 0.5-12 μm, 1-10 μm, 2-8 μm, 0.2-5 μm, 1-4 μm, 2-3 μm, or 2.5-3 μm; or (d) any combination of one, two, or three of (a) to (c).

In some embodiments, the barrier coating composition, in final form, has a bulk viscosity ranging from 40-2000 cPs, 100-800 cPs, 150-650 cPs, or 200-400 cPs and a stability greater than 3 months at 25° C.

Barrier Coatings

In some exemplary embodiments according to any of the foregoing the barrier coating composition, when applied as one or more coatings to a lignocellulosic substrate, including but not limited to paper, paperboard, lightweight wrapping paper basesheets, fast food wrapping paper basesheets, molded fibers, or 100% recycled linerboard sheets, wherein said one or more coatings are formed at room temperature, 15-30° C., or 20-25° C. using a conventional paper coater, rolling-coater, or metering size press machine, followed by oven curing at 100-120° C., 105-115° C., or 108-112° C., for a suitable time, optionally 60-120 sec, 70-110 sec, 80-100 sec, or 90-95 sec results in one or more of the following:

(a) said barrier coating composition forms a single coat layer, a basecoat layer, a topcoat layer, a double-coating comprising a basecoat layer and a topcoat layer comprising the same barrier coating composition, a double-coating comprising a basecoat layer and a topcoat layer comprising different barrier coating compositions, or multiple coating layers;

(b) said one or more coatings provide a barrier to transmittance of one or more of oil, grease, or water, preferably oil and/or grease, into or through said lignocellulosic substrate at temperatures ranging from 5-95° C., 15-90° C., 25-85° C., or 40-60° C., wherein said barrier to transmittance is greater than or equal to one or more coatings formed in the same manner from said polyhydroxyalkanoates (PHA) alone;

(c) said one or more coatings, when applied at a coat weight of 1-30, 2-20, 3-10, or 4-8 grams per square meter (gsm), result in KIT test values (i.e., a measure of oil and grease resistance) and optionally Cobb 1 min test values (i.e., a measure of mass of water absorbed per square meter over 1 min) that are equal to or enhanced (i.e., higher KIT values and lower Cobb values) compared one or more coatings formed in the same manner from said polyhydroxyalkanoates (PHA) alone;

(d) said one or more coatings, when applied at a coat weight of 1-30, 2-20, 3-10, or 4-8 grams per square meter (gsm) displays a coat weight dependent decrease in Cobb 1 min test results; and (e) said one or more coatings, in final form, comprise a percent bio-based material of ≥50 wt %, 50-80 wt %, 50-70 wt %, 50-60 wt %, or 50-55 wt %.

Methods for Preparing Barrier Coating Compositions

In another aspect, the present invention provides a method for preparing a barrier coating composition for paper or board, optionally an oil barrier coating composition according to any of the foregoing compositions, the method comprising:

(a) forming at least one biowax emulsion, preferably as an inverse phase emulsion;

(b) forming or providing one or more polyhydroxyalkanoates (PHA);

(c) dispersing said at least one biowax emulsion into said one or more polyhydroxyalkanoates (PHA);

(d) dispersing one or more rheology modifiers into said one or more polyhydroxyalkanoates (PHA); and (e) dispersing one or more auxiliary additives into said one or more polyhydroxyalkanoates (PHA);

wherein steps (c)-(e) are effected together or separately.

In another aspect, the present invention provides a method for preparing a barrier coating composition for paper or board, optionally according to any of the foregoing compositions, the method comprising:

(a) forming at least one biowax emulsion, preferably as an inverse phase biowax emulsion;

(b) dispersing said inverse phase biowax emulsion into one or more polyhydroxyalkanoates (PHA);

(c) dispersing one or more rheology modifiers into said one or more polyhydroxyalkanoates (PHA); and (d) dispersing one or more auxiliary additives into said one or more polyhydroxyalkanoates (PHA);

wherein step (a) is performed prior to step (b) and steps (b)-(d) are effected together, or separately in the order of (b), (c), then (d), or optionally in any order In some exemplary embodiments of the method said at least one biowax emulsion comprises:

(a) one or more biowaxes selected from the group consisting of palm oil wax, castor oil wax, soybean oil wax, fish oil wax, tallow oil wax, a plant oil wax, an animal oil wax, a blend of plant and animal oil waxes, or any combination thereof, wherein said one or more biowaxes (i) comprise one or more hydrogenated bio-based oils including, but not limited to, palm oil, castor oil, soybean oil, fish oil, tallow oil, a plant oil, an animal oil, a blend of plant and animal oils, or any combination thereof, wherein each of said hydrogenated bio-based oils have a higher melting point compared to the corresponding non-hydrogenated bio-based oil and (ii) has a melting point of 55-98° C., 60-95° C., 65-90° C., 70-85° C., or 75-80° C.;

(b) one or more rosin sizing agents, including but not limited to, fortified rosins, esterified rosins, rosin waxes, resin acid derivatives, gum rosins, wood rosins, tall oil rosins, rosin pastes, rosin-based dispersants, or any combination thereof;

(c) one or more surfactants comprising nonionic surfactants, anionic surfactants, or a combination thereof, wherein (i) said nonionic surfactants are selected from ethoxylated alcohols, including but not limited to, secondary alcohol ethoxylates, ethoxylated sorbitan esters, sorbitan esters, glycerol esters, including but not limited to, glycerol monostearate (GMS), and any combination thereof, and (ii) said anionic surfactants are selected from, fatty alcohol ether sulfates, alkyl ether sulfates, special soaps, including but not limited to, anionic long chain fatty acids, and any combination thereof;

(d) one or more microcrystalline or paraffinic waxes, including but not limited to saturated hydrocarbon waxes, paraffinic hydrocarbon waxes, isoparaffinic hydrocarbon waxes, naphthenic hydrocarbon waxes, and any mixture thereof, having a congealing point of 50-110° C., 65-100° C., 70-90° C., or 75-85° C.; and (e) optionally, one or more long chain fatty acids having a carbon chain length ranging from C4-C30, C20-C30, C22-C30, or C24-C30.

In some exemplary embodiments of the method said at least one biowax emulsion comprises:

(a) said one or more biowaxes in an amount ranging from 20-60 wt %, 25-55 wt %, 30-50 wt %, or 35-45 wt %; (b) said one or more rosin sizing agents in an amount ranging from 1-12 wt %, 2-10 wt %, 3-8 wt %, or 4-6 wt %; (c) said one or more surfactants in an amount ranging from 2-12 wt %, 4-10 wt %, or 6-8 wt %; (d) said one or more microcrystalline or paraffinic waxes in an amount ranging from 2-10 wt %, 3-9 wt %, 4-8 wt %, or 5-7 wt %; and (e) optionally, said one or more long chain fatty acids in an amount ranging from 0.5-6 wt %, 1-5 wt %, or 2-4 wt %, wherein said at least one biowax emulsion comprises an inverse phase biowax emulsion formed by:

(i) combining said one or more biowaxes, said one or more rosin sizing agents, said one or more surfactants, said one or more microcrystalline or paraffinic waxes, and optionally said one or more long chain fatty acids in a reactor and heating to 70-99° C., 75-98° C., 85-95° C., or 90-95° C. to form an oil-phase; (ii) adding an amount of water, optionally hot water, optionally 70-99° C., 75-98° C., or 85-95° C. water to said oil-phase; (iii) heating to 70-99° C., 75-98° C., or 85-95° C. and then emulsifying, optionally for an amount of time ranging from 0.5-5 h, 0.5-4 h, or 1-3 h; (iv) homogenizing; (v) cooling the resulting inverse phase biowax emulsion to a temperature ranging from 10-35° C., 15-30° C., or 20-25° C., optionally by means of an ice-water bath, a cooling jacket, or a cooling core; and (vi) optionally adding a biocide.

In some exemplary embodiments of the method said at least one biowax emulsion, in final form comprises a total solids content ranging from 50-80 wt %, 50-70 wt %, 50-60 wt %, or 55-57 wt % and further wherein ≥50 wt % of said total solids content is bio-based.

In some embodiments of the method said at least one biowax emulsion has a final bulk viscosity ranging from 1400-1800 cPs, 1500-1700 cPs, 1550-1650 cPs, or 1590-1610 cPs.

In some exemplary embodiments of the method:

(a) said one or more polyhydroxyalkanoates (PHA) comprise an aqueous polyhydroxyalkanoate (PHA) dispersion comprising one or more polyhydroxyalkanoate (PHA) polymers, wherein said aqueous polyhydroxyalkanoate (PHA) dispersion has a total dry solids content ranging from 10-70 wt %, 40-60 wt %, 45-55 wt %, or 49-51 wt %, (b) said one or more rheology modifiers comprise hydroxypropyl methylcellulose (HPMC), one or more bio-based gums, including but not limited to, pre-hydrated cellulose gums, xanthan gums, or a mixture thereof, one or more bio-based hydrocolloids, one or more polyacrylate dispersants, including but not limited to polyacrylate dispersants having a charge ranging from 70-100 mol %, 80-100 mol %, or 90-100 mol % and a molecular weight ranging from 1000-100,000 Da, 2000-80,000 Da, or 10,000-50,000 Da, or a combination thereof; and (c) said one or more auxiliary additives are selected from clay, kaolin, alumina, silica, nano-clay, nanocellulose, nano-structured cellulose, cellulose nanofibers (CNF), nano-fibrillated cellulose (NFC), bacterial nanocellulose, cellulose nanocrystals (CNC), micro-fibrillated cellulose (MFC), and microcrystalline cellulose (MCC), and any combination thereof, wherein (i) said clay and/or nano-clay is formulated as an aqueous slurry having total solids of 60-80 wt %, 65-75 wt %, or 68-72 wt % prior to being dispersed into said barrier coating composition;

(ii) said cellulose nanocrystals (CNC) are formulated as an aqueous slurry or a spray-dried powder prior to being dispersed into said barrier coating composition, and are optionally produced by acid hydrolysis of cellulose;

(iii) said micro-fibrillated cellulose (MFC) (i) has an average particle length ranging from 20-200 μm, 50-200 μm, 100-200 μm, or 150-200 μm, (ii) has an average particle width ranging from 0.1-1 μm, 0.2-1 μm, 0.4-1 μm, or 0.6-1 μm, and (iii) is formulated as an aqueous solution having a dry content of 10-30 wt %, 15-25 wt %, or 18-22 wt % prior to formulation with said barrier coating composition; and (iv) said microcrystalline cellulose (MCC) (i) has an average particle size ranging from 1-8 μm, 2-7 μm, 3-6 μm, or 4-5 μm, and (ii) is formulated as an aqueous slurry or a spray-dried powder prior to being dispersed into said barrier coating composition.

In some embodiments of the method said barrier coating composition comprises:

(a) said at least one biowax emulsion in an amount ranging from 30-90 wt %, 40-90 wt %, 50-90 wt %, 60-90 wt %, or preferably 70-90 wt %; (b) said one or more polyhydroxyalkanoates (PHA) in an amount ranging from 10-70 wt %, 10-60 wt %, 10-50 wt %, 10-40 wt %, 10-35 wt %, or preferably 10-30 wt %; (c) said one or more rheology modifiers in an amount ranging from 0.1-5 wt %, 0.1-4 wt %, or 0.1-3 wt %; and (d) said one or more auxiliary additives in an amount ranging from 0.1-10 wt %, 1-9 wt %, 1-8 wt %, 1-6 wt %, or 1-3 wt %, wherein said at least one biowax emulsion, said one or more rheology modifiers, and said one or more auxiliary additives are dispersed, separately or together, into said one or more polyhydroxyalkanoates (PHA) with mechanical mixing to form said barrier coating composition, wherein, in final form, said barrier coating composition (i) comprises a total solids content ranging from 30-70 wt %, 40-60 wt %, 45-55 wt %, or 48-52 wt %; (ii) comprises a bio-based solids content ranging from 40-90 wt %, 45-80 wt %, 50-70 wt %, or 55-60 wt % of said total solids content; (iii) has a particle size ranging from 0.2-15 μm, 0.2-15 μm, 0.5-12 μm, 1-10 μm, 2-8 μm, 0.2-5 μm, 1-4 μm, 2-3 μm, or 2.5-3 μm; or (iv) any combination of one, two, or three of (i) to (iii).

In some embodiments of the method, the dosage of said one or more rheology modifiers is modified to achieve a final bulk viscosity of the barrier coating composition of 40-2000 cPs or 150-800 cPs. In some embodiments of the method, the barrier coating composition has a bulk viscosity ranging from 40-2000 cPs, 100-700 cPs, 150-650 cPs, or 200-400 cPs. In some embodiments of the method, the barrier coating composition comprises a stable dispersion having a stability greater than 3 months at 25° C.

In some exemplary embodiments of the method said barrier coating composition is applied as one or more coatings to a lignocellulosic substrate, including but not limited to paper, paperboard, lightweight wrapping paper basesheets, fast food wrapping paper, molded fibers, or 100% recycled linerboard sheets, wherein said one or more coatings are formed at room temperature, 15-30° C., or 20-25° C. using a conventional paper coater, rolling-coater, or metering size press machine, followed by oven curing at 100-120° C., 105-115° C., or 108-112° C., for a suitable time, optionally 60-120 sec, 70-110 sec, 80-100 sec, or 90-95 sec, and wherein application of said barrier coating composition to said lignocellulosic substrate results in one or more of the following:

(a) said barrier coating composition forms a single coat layer, a basecoat layer, a topcoat layer, a double-coating comprising a basecoat layer and a topcoat layer comprising the same barrier coating composition, a double-coating comprising a basecoat layer and a topcoat layer comprising different barrier coating compositions, or multiple coating layers;

(b) said one or more coatings provide a barrier to transmittance of one or more of oil, grease, or water, preferably oil and/or grease, into or through said lignocellulosic substrate at temperatures ranging from 5-95° C., 15-90° C., 25-85° C., or 40-60° C., wherein said barrier to transmittance is greater than or equal to one or more coatings formed in the same manner from said polyhydroxyalkanoates (PHA) alone;

(c) said one or more coatings, when applied at a coat weight of 1-30, 2-20, 3-10, or 4-8 grams per square meter (gsm), result in KIT test values (i.e., a measure of oil and grease resistance) and optionally Cobb 1 min test values (i.e., a measure of mass of water absorbed per square meter over 1 min) that are equal to or enhanced (i.e., higher KIT values and lower Cobb values) compared one or more coatings formed in the same manner from said polyhydroxyalkanoates (PHA) alone;

(d) said one or more coatings, optionally when applied at a coat weight of 1-30, 2-20, 3-10, or 4-8 grams per square meter (gsm) display a coat weight dependent decrease in Cobb 1 min test results; and (e) said one or more coatings, in final form, comprise a percent bio-based material of ≥50 wt %, 50-80 wt %, 50-70 wt %, 50-60 wt %, or 50-55 wt %.

In another aspect, the present invention provides a lignocellulosic substrate, including but not limited to paper, paperboard, lightweight wrapping paper basesheets, fast food wrapping paper, molded fibers, or 100% recycled linerboard sheets, comprising one or more coatings of a barrier coating composition according to any of the foregoing compositions, or produced by a method according to any of the foregoing methods.

In another aspect, the present invention provides a sheet-like product for use as a food service package, a beverage service package, or any package suitable for the transport and/or storage of materials comprising oil, grease, and/or water, preferably oil and/or grease, comprising:

(a) a substrate comprising lignocellulosic fibers, and having a first parallel large surface and a second parallel large surface, and (b) a coating structure comprising a barrier coating composition according to any one of the foregoing compositions applied in at least one layer to at least one of the large surfaces of the substrate, wherein said sheet-like product has (i) a KIT test value of 11-12, or 12; and (ii) optionally a Cobb 1 min value of less than 6 gsm.

In another aspect, the present invention also provides a sheet-like product for use as a food service package, a beverage service package, or any package suitable for the transport and/or storage of materials comprising oil, grease, and/or water, preferably oil and/or grease, comprising:

(a) a substrate comprising lignocellulosic fibers, and having a first parallel large surface and a second parallel large surface, and (b) a coating structure comprising a barrier coating composition prepared according to any one of the foregoing methods applied in at least one layer to at least one of the large surfaces of the substrate, wherein said sheet-like product has (i) a KIT test value of 11-12, or 12; and (ii) optionally a Cobb 1 min value of less than 6 gsm.

The methods and compositions illustratively disclosed herein suitably may be practiced in the absence of any element which is not specifically disclosed herein and/or any element specifically disclosed herein. Exemplary embodiments of the invention and its advantages are further disclosed in the following examples.

EXAMPLES

The examples provided herein are for illustrative purposes so that the invention may be more fully understood. These examples should not be construed as limiting the invention in any way.

Example 1: Preparation of Barrier Coating Compositions

Barrier coating compositions were prepared to be evaluated as coatings for paper or paperboard.

TABLE 1

Biowax Emulsions.

| Biowax Emulsion | Biowax (wt %) | Rosin Size (wt %) | Surfactants (wt %) | Microcrystalline Wax (wt %) | Long Chain Fatty Acids (wt %) | Additive (wt %) |
|---|---|---|---|---|---|---|
| BE1 | Castor wax (36%) | Fortified rosin size (3%) | Nonionic and anionic* (5%) | Melt Point >70° C. (6%) | C22 (2%) | Organic Base (2%) |

*nonionic surfactants: ethoxylated alcohols and esters; anionic surfactants: fatty alcohol ether sulfates, alkyl ether sulfates, special soaps High solid biowax emulsions (total solids, TS over 50%) were prepared from castor wax, rosin size, nonionic and anionic surfactants, microcrystalline wax, long chain fatty acids, and optional additives according to Table 1. The components were blended to form an inverse phase emulsion and then cooled using a quick cooling process.

Inverse phase emulsions were formed by combining components according to Table 1 in a reactor and heating to a temperature ranging from 90-95° C. to form an oil-phase, to which was added an amount of hot water. The mixture was emulsified at 75-98° C. for 0.5-4 h, homogenized, and then cooled to a temperature ranging from 15-25° C. A biocide was then added.

Quick cooling was achieved by cooling the resulting inverse phase emulsion by means of an ice-water bath, a cooling jacket, or a cooling core to a temperature ranging from 15-25° C.

The final biowax emulsion, BE1, yielded a bulk viscosity of 1600 cPs and total solids of 56%.

Barrier Coating Compositions (Bcc)

TABLE 2

Barrier coating compositions (BCC).

| Barrier Coating Composition | PHA (wt %) | BE1 (wt %) | Rheology Modifier 1 (wt %) | Rheology Modifier 2 (wt %) | Auxiliary Additive (wt %) | Auxiliary Additive (wt %) |
|---|---|---|---|---|---|---|
| Control | 99% | None | Polyacrylate (1%) | None | None | None |
| BCC1 | 89% | 10% | Polyacrylate (1%) | None | None | None |
| BCC2 | 79% | 20% | Polyacrylate (1%) | None | None | None |
| BCC3 | 69% | 30% | Polyacrylate (1%) | None | None | None |
| BCC4 | 68% | 28% | Polyacrylate (1%) | None | CNC (3%) | None |
| BCC5 | 47% | 50% | Polyacrylate (1%) | None | MFC (2%) | None |
| BCC6 | 47% | 50% | Polyacrylate (1%) | None | MCC (2%) | None |
| BCC7 | 46% | 50% | Polyacrylate (1%) | None | CNC (3%) | None |
| BCC8 | 32% | 60% | Polyacrylate (1%) | None | MCC (2%) | Clay (5%) |
| BCC9 | 20% | 73% | None | HPMA (1%) | MCC (1%) | Clay (5%) |

Barrier coating compositions (BCC1-BCC8) were prepared by combining high solids biowax emulsion (BE1), bio-based rheology modifiers, and auxiliary additives into a polyhydroxyalkanoate (PHA) carrier, which was used as a control, according to Table 2. Barrier coating compositions BCC1-BCC3 contained rheology modifier and no auxiliary additives, BCC4 contained rheology modifier and one auxiliary additive, achieving very good oil barrier properties, and BCC5-BCC7 contained one auxiliary additives. BCC9 contained rheology modifier2 and two auxiliary additives, achieving the target KIT value of 12. BCC9 is the most stable dispersion and has good rheological properties for paper coating applications.

The PHA dispersion is commercially available and is a fully bio-based alternative to polyethylene (PE) for manufacturing recyclable, barrier coated paper and board products from renewable sources. PHA itself has been used as a coating for paper or board products, such as a coffee cups, to keep moisture and water from leaking through the cup material. 100% PHA coating dispersion provides paper excellent barriers against water, moisture, but unacceptable oil resistance.

The inventive barrier coating compositions were formed by directly dispersing components according to Table 2 into the PHA dispersion to form stable biowax barrier coating dispersions with final bulk viscosities generally in the range of 150-600 cPs. The biowax dosage levels were in the range of 30-60 wt % of total dry coating solids.

A dispersion of polyacrylate was used as Rheology modifier 1. Hydroxypropyl methylcellulose (HPMC) (Rheology Modifier 2 in Table 2) belongs to the group of cellulose ethers in which hydroxyl groups have been substituted with one or more of the three hydroxyl groups present in the cellulose ring. HPMC is a spray-dried powder and directly dispersed into the barrier coating composition.

MCC having an average particle size ranging from 3-6 μm was formulated as a spray dried powder prior to being dispersed into the barrier coating composition.

Where indicated, sugar beet micro-fibrillated cellulose (MFC), produced by Atrex from parenchymal cellulose (non-wood), was added. The MFC had (i) a dry content of 20 wt %, (ii) an average particle length less than 200 μm, (iii) an average particle width less than 1 μm, and (iv) is formulated as an aqueous solution having a dry content of 10-30 wt % prior to being dispersed into the barrier coating composition.

Where indicated, clay at a low dosage range was added to stabilize final barrier coating dispersions. Clay was formulated as an aqueous slurry having total solids of 70 wt % prior to being dispersed into the barrier coating composition.

Where indicated, microcrystalline cellulose (MCC), which has the ability to provide barrier enhancing properties, was added. MCC having an average particle size ranging from 3-6 μm was formulated as a spray-dried powder prior to being dispersed into the barrier coating composition.

Results: The resulting barrier coating compositions (i) contained total coating solids>50 wt % and total renewable materials, including bio and natural content, up to 85 wt %, (ii) have at least 3 months shelf life, and (iii) have good coating rheology properties suitable for conventional paper coaters at ambient temperature conditions.

Stability testing was performed by aging a biowax barrier coating dispersion for 3 months at 25° C. The bulk viscosity of coating dispersion slowly increased to a stable maximum. If the aged dispersion formed a gel within 3 months, the sample was considered unstable.

These results provide initial proof of concept that biowax emulsions can be dispersed into a PHA dispersion to provide barrier coating composition dispersions with high stability (>3 months), high total solids (>50%) and a high percentage (up to 90 wt %) of solids from bio-based content (i.e., sustainable and renewable sources). Bulk viscosities were suitable for use on either conventional paper coaters or metering size press machines under room temperature conditions.

Example 2: Evaluation of Barrier Coatings for Lightweight Wrapping Paper

Substrates for barrier coatings were HAVI lightweight wrapping paper basesheets with basis wt=36 g/m$^2$ (gsm), Cobb 1 min=45 gsm, and no surface size.

Barrier coating compositions (PHA control and BCC1-3) were applied to basesheets by roller-coating, followed by oven curing at 110° C. for 90 secs. A double-coating (same barrier coating composition for topcoat and basecoat) of each barrier coating composition was applied to a single side of the base-sheet. Oven curing was performed after each coat application. Average total coat weight was 12 gsm.

Kit tests were performed to measure the oil and grease resistance (OGR) level of the barrier coated sheets. Kit test values generally range from 1-12, with 1 indicating no OGR barrier and 12 indicating very good OGR. Kit test results are shown in FIG. 1.

These results demonstrate that the control PHA coating dispersion requires a double coating application to achieve complete coating coverages on paper surfaces; however, the control PHA coating dispersion did still not achieve a target Kit value of 12 with double-coating application. Barrier coating compositions BCC1-BCC3, comprising 10-30 wt % of biowax emulsions dispersed into the PHA dispersion, achieved higher Kit values indicating improved oil and grease resistance.

These results provide initial proof of concept that the present barrier coating compositions can be effectively used as natural and bio-based barrier coatings for production of food wrapping paper with improved OGR over PHA alone.

Example 3: Evaluation of Auxiliary Additives in Barrier Coatings for Lightweight Wrapping Paper Substrates for barrier coatings were described in Example 2.

Barrier coating compositions (control and BCC 4-7) were applied to lightweight wrapping paper basesheets by roller-coating, followed by oven curing at 110° C. for 90 secs. A single-coating of each barrier coating composition was applied to a single side of the base-sheet. Average total coat weight was 6 gsm.

Figure 2:
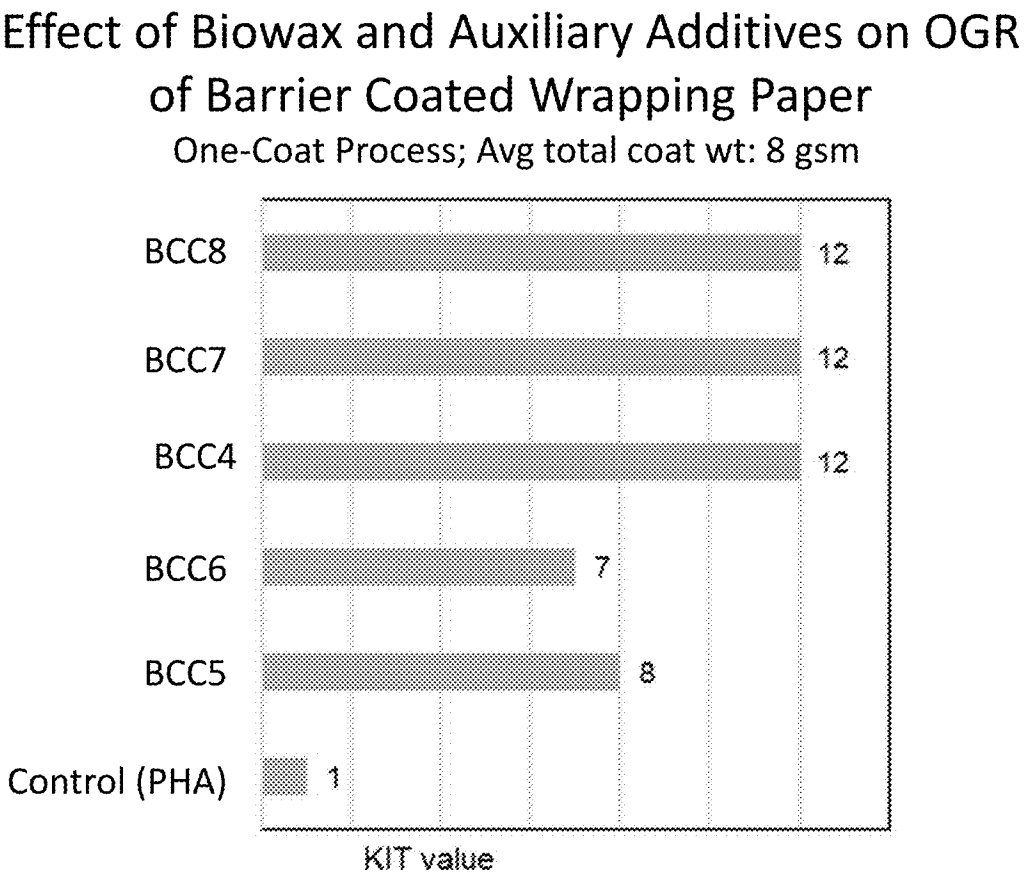
FIG. 2 provides an exemplary bar graph of KIT values indicating oil and grease resistance for barrier-coated wrapping paper basesheets coated with single-layer barrier coating compositions according to Example 3.
Figure 3:
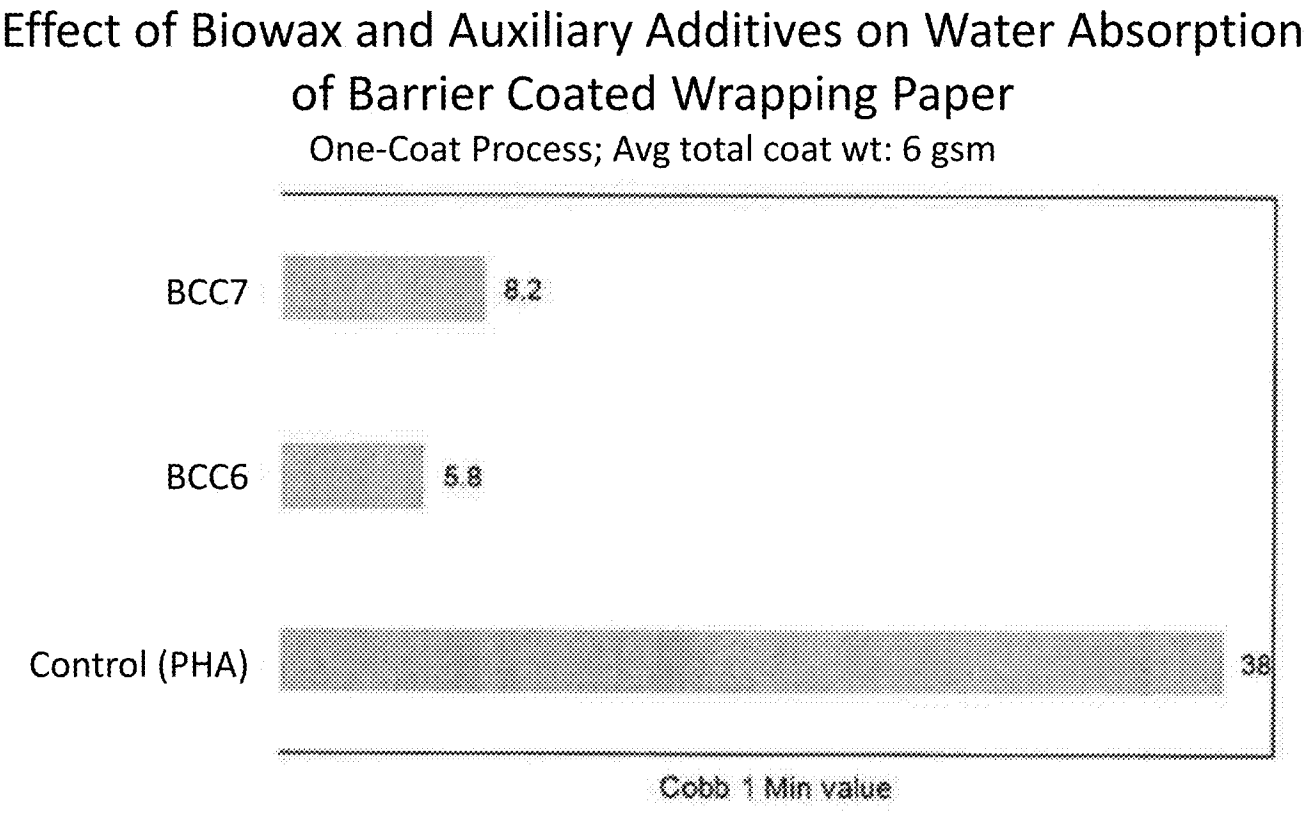
FIG. 3 provides an exemplary bar graph of Cobb 1 min values indicating water absorption for barrier-coated wrapping paper basesheets coated with single-layer barrier coating compositions according to Example 3.

Kit tests were performed to measure the oil and grease resistance (OGR) level of the barrier coated sheets. KIT test results are shown in FIG. 2. For sheets coated with control, BCC6, and BCC7, Cobb 1 min tests were performed to determine the mass of water that can be absorbed by the surface of the barrier coated sheets, in g/m$^2$ (gsm) over a given time (e.g., 1 min). Cobb 1 min test results are shown in FIG. 3. BCC7 and BCC8 (data not shown) were the best barrier coating formulations for OGR wrapping paper applications and were able to achieve KIT values of 12.

These results demonstrate that control PHA coating dispersion yielded poor oil resistance because of incomplete coating coverages on paper surfaces with a single coating application. Coatings of BCC4 (PHA+50% Biowax+2% MFC) and BCC5 (PHA+50% Biowax+2% MCC) yielded significantly better KIT values than PHA alone, indicating that the auxiliary additives of MCC and nano-clay, at low dosage levels, further increased the oil resistance of biowax/PHA formulations.

Coatings of BCC 6 (PHA+50% Biowax+3% CNC) and BCC7 (PHA+60% Biowax+2% MCC+5% clay) achieved complete coating coverages on paper surfaces by a single coating application and yielded KIT values of 12, a dramatic increase over PHA alone. Coatings of BCC6 and BCC7 provided significantly better water resistance than PHA, with BCC6 yielding the best Cobb 1 min result.

These results provide initial proof of concept that the present biowax based barrier coating compositions can be effectively used to coat sheet-like products for use as a food service package, a beverage service package, or any package suitable for the transport and/or storage of materials comprising oil, water, and/or grease at a low coat weight range of 6-8 gsm.

What is claimed is:

1. A barrier coating composition for paper or board, said barrier coating composition comprising:

(a) one or more biowax emulsions;

(b) one or more polyhydroxyalkanoates (PHA);

(c) one or more rheology modifiers;

(d) one or more auxiliary additives; and wherein (e) the amount of said one or more biowax emulsions in the barrier coating composition ranges from 30-90 wt %; and (f) the amount of said one or more polyhydroxyalkanoates (PHA) in the barrier coating composition ranges from 10-70 wt %.

2. The barrier coating composition of claim 1, wherein said one or more biowax emulsions comprise:

(a) one or more biowaxes comprising palm oil wax, castor oil wax, soybean oil wax, fish oil wax, tallow oil wax, a plant oil wax, an animal oil wax, a blend of plant and animal oil waxes, or any combination thereof;

(b) one or more rosin sizing agents comprising fortified rosins, esterified rosins, rosin waxes, resin acid derivatives, gum rosins, wood rosins, tall oil rosins, rosin pastes, rosin-based dispersants, or any combination thereof;

(c) one or more surfactants comprising nonionic surfactants, anionic surfactants, or a combination thereof, wherein (i) said nonionic surfactants are selected from ethoxylated alcohols, including but not limited to, secondary alcohol ethoxylates, ethoxylated sorbitan esters, sorbitan esters, glycerol esters, including but not limited to, glycerol monostearate (GMS), and any combination thereof, and (ii) said anionic surfactants are selected from, fatty alcohol ether sulfates, alkyl ether sulfates, special soaps, including but not limited to, anionic long chain fatty acids, and any combination thereof;

(d) one or more microcrystalline or paraffinic waxes comprising saturated hydrocarbon waxes, paraffinic hydrocarbon waxes, isoparaffinic hydrocarbon waxes, naphthenic hydrocarbon waxes, and any mixture thereof, having a congealing point of 50-110° C. and wherein the amount of said one or more biowax emulsions in the barrier coating composition ranges from 70-90 wt %; and the amount of said one or more polyhydroxyalkanoates (PHA) in the barrier coating composition ranges from 10-30 wt %.

3. The barrier coating composition of claim 2, wherein said one or more biowaxes:

(a) comprise one or more hydrogenated bio-based oils including, but not limited to, palm oil, castor oil, soybean oil, fish oil, tallow oil, a plant oil, an animal oil, a blend of plant and animal oils, or any combination thereof, and wherein each of said hydrogenated bio-based oils has a higher melting point compared to the corresponding non-hydrogenated bio-based oil; and/or (b) have a melting point of 55-98° C.

4. The barrier coating composition of claim 2, wherein, one or more of the biowax emulsions in the barrier coating comprise at least one of the following:

(a) said one or more biowaxes comprise castor oil wax;

(b) said one or more rosin sizing agents comprise fortified rosin size;

(c) said nonionic surfactants comprise secondary alcohol ethoxylates, glycerol monostearate (GMS), or a combination thereof and said anionic surfactants comprise anionic long chain fatty acids, or a combination thereof;

(d) said one or more microcrystalline or paraffinic waxes have a congealing point of 70-90° C.; or (e) any combination of (a)-(d).

5. The barrier coating composition of claim 2, wherein one or more of the biowax emulsions in the barrier coating comprise one or more of the following:

(a) said one or more biowaxes in an amount ranging from 20-60 wt %;

(b) said one or more rosin sizing agents in an amount ranging from 1-12 wt %;

(c) said one or more surfactants in an amount ranging from 2-12 wt %;

(d) said one or more microcrystalline or paraffinic waxes in an amount ranging from 2-10 wt %; or (e) any combination of (a)-(d).

6. The barrier coating composition of claim 2, wherein said one or more biowax emulsions comprise an inverse phase biowax emulsion formed by:

(a) combining said one or more biowaxes, said one or more rosin sizing agents, said one or more surfactants, and said one or more microcrystalline or paraffinic waxes in a reactor and heating to 70-99° C. to form an oil-phase;

(b) adding an amount of water to said oil-phase;

(c) heating to 70-99° C. and then emulsifying;

(d) homogenizing; and (e) cooling the resulting inverse phase emulsion to a temperature ranging from 10-35° C.

7. The barrier coating composition of claim 1, wherein:

(i) one or more of the biowax emulsions in the barrier coating, in final form comprise a total solids content ranging from 50-80 wt % and further wherein ≥50 wt % of said total solids content is bio-based;

(ii) said one or more polyhydroxyalkanoates (PHA) comprise an aqueous polyhydroxyalkanoate (PHA) dispersion comprising one or more polyhydroxyalkanoate (PHA) polymers, wherein said aqueous polyhydroxyalkanoate (PHA) dispersion has a total dry solids content ranging from 10-70 wt %;

(iii) said one or more rheology modifiers comprise hydroxypropyl methylcellulose (HPMC), one or more bio-based gums, including but not limited to, prehydrated cellulose gums, xanthan gums, or a mixture thereof, one or more bio-based hydrocolloids, one or more polyacrylate dispersants having a charge ranging from 70-100 mol % and a molecular weight ranging from 1000-100,000 Da, or a combination thereof;

(iv) said one or more auxiliary additives are selected from nanocellulose, nano-structured cellulose, cellulose nanofibers (CNF), nano-fibrillated cellulose (NFC), bacterial nanocellulose, cellulose nanocrystals (CNC), micro-fibrillated cellulose (MFC), microcrystalline cellulose (MCC), or any combination thereof; or (v) said one or more auxiliary additives further comprise clay, kaolin, alumina, silica, nano-clay, or any combination thereof; or (vi) any combination of (i) to (iv).

8. The barrier coating composition of claim 7, wherein in said one or more auxiliary additives:

(a) said clay and/or nano-clay is formulated as an aqueous slurry having total solids of 60-80 wt % prior to being dispersed into said barrier coating composition;

(b) said cellulose nanocrystals (CNC) are formulated as an aqueous slurry or a spray-dried powder prior to being dispersed into said barrier coating composition;

(c) said micro-fibrillated cellulose (MFC) (i) has an average particle length ranging from 20-200 μm, (ii) has an average particle width ranging from 0.1-1 μm, and (iii) is formulated as an aqueous solution having a dry content of 10-30 wt % prior to formulation with said barrier coating composition;

(d) said microcrystalline cellulose (MCC) (i) has an average particle size ranging from 1-8 μm, and (ii) is formulated as an aqueous slurry or a spray-dried powder prior to being dispersed into said barrier coating composition; or (e) any combination of (a)-(d).

9. The barrier coating composition of claim 1, wherein:

(a) said one or more auxiliary additives comprise microfibrillated cellulose (MFC), microcrystalline cellulose (MCC), cellulose nanocrystals (CNC), or a combination thereof;

(b) said one or more auxiliary additives comprise microcrystalline cellulose (MCC), and one or more of clay, kaolin, nano-clay, or any combination thereof;

(c) said one or more auxiliary additives comprise clay and microcrystalline cellulose (MCC); or (d) said one or more auxiliary additives comprise cellulose nanocrystals (CNC); or (e) any combination of (a) to (d).

10. The barrier coating composition of claim 1, wherein said barrier coating composition comprises:

(a) a dispersion formed by dispersing, separately or together, said one or more biowax emulsions, said one or more rheology modifiers, and said one or more auxiliary additives into said one or more polyhydroxyalkanoates (PHA) with mechanical mixing to form said dispersion;

(b) a particle size ranging from 0.2-15 μm;

(c) said one or more biowax emulsions in an amount ranging from 70-90 wt %;

(d) said one or more polyhydroxyalkanoates (PHA) in an amount ranging from 10-30 wt %;

(e) said one or more rheology modifiers in an amount ranging from 0.1-5 wt %;

(f) said one or more auxiliary additives in an amount ranging from 0.1-10 wt %; or (g) any combination of (a) to (f).

11. The barrier coating composition of claim 1, when applied as one or more coatings to a lignocellulosic substrate, including but not limited to paper, paperboard, lightweight wrapping paper basesheets, fast food wrapping paper basesheets, molded fibers, or 100% recycled linerboard sheets, wherein said one or more coatings are formed at room temperature, 15-30° C. using a conventional paper coater, rolling-coater, or metering size press machine, followed by oven curing at 100-120° C., and wherein the application of said barrier coating composition to said lignocellulosic substrate results in one or more of the following:

(a) said barrier coating composition forms a single coat layer, a basecoat layer, a topcoat layer, a double-coating comprising a basecoat layer and a topcoat layer comprising the same barrier coating composition, a double-coating comprising a basecoat layer and a topcoat layer comprising different barrier coating compositions, or multiple coating layers;

(b) said one or more coatings provide a barrier to transmittance of one or more of oil, grease, or water, preferably oil and/or grease, into or through said lignocellulosic substrate at temperatures ranging from 5-95° C. wherein said barrier to transmittance is greater than or equal to one or more coatings formed in the same manner from said polyhydroxyalkanoates (PHA) alone;

(c) said one or more coatings, when applied at a coat weight of 1-30 grams per square meter (gsm), result in KIT test values (i.e., a measure of oil and grease resistance) that are equal to or higher KIT values compared one or more coatings formed in the same manner from said polyhydroxyalkanoates (PHA) alone;

(d) said one or more coatings, when applied at a coat weight of 1-30 grams per square meter (gsm) displays a coat weight dependent decrease in Cobb 1 min test results;

(e) said one or more coatings, in final form, comprise a percent bio-based material of 50-80 wt %;

(f) said one or more coatings applied at a coat weight of 1-30 grams per square meter (gsm) result in Cobb 1 min test values (i.e., a measure of mass of water absorbed per square meter over 1 min) that are equal to or lower compared one or more coatings formed in the same manner from said polyhydroxyalkanoates (PHA) alone; or (g) any combination of (a)-(f).

12. A method for preparing a barrier coating composition for paper or board according to claim 1, the method comprising:

(a) dispersing at least one biowax emulsion into one or more polyhydroxyalkanoates (PHA);

(b) dispersing one or more rheology modifiers into said one or more polyhydroxyalkanoates (PHA); and (c) dispersing one or more auxiliary additives into said one or more polyhydroxyalkanoates (PHA);

wherein steps (a)-(c) are effected together or separately in any order; and wherein (d) the amount of said one or more biowax emulsions in the barrier coating composition ranges from 30-90 wt %; and (e) the amount of said one or more polyhydroxyalkanoates (PHA) in the barrier coating composition ranges from 10-70 wt %.

13. The method of claim 12, wherein said at least one biowax emulsion comprises:

(a) one or more biowaxes comprising palm oil wax, castor oil wax, soybean oil wax, fish oil wax, tallow oil wax, a plant oil wax, an animal oil wax, a blend of plant and animal oil waxes, or any combination thereof, wherein said one or more biowaxes (i) comprise one or more hydrogenated bio-based oils including, but not limited to, palm oil, castor oil, soybean oil, fish oil, tallow oil, a plant oil, an animal oil, a blend of plant and animal oils, or any combination thereof, wherein each of said hydrogenated bio-based oils have a higher melting point compared to the corresponding non-hydrogenated bio-based oil and (ii) has a melting point of 55-98° C.;

(b) one or more rosin sizing agents comprising fortified rosins, esterified rosins, rosin waxes, resin acid derivatives, gum rosins, wood rosins, tall oil rosins, rosin pastes, rosin-based dispersants, or any combination thereof;

(c) one or more surfactants comprising nonionic surfactants, anionic surfactants, or a combination thereof, wherein (i) said nonionic surfactants are selected from ethoxylated alcohols, including but not limited to, secondary alcohol ethoxylates, ethoxylated sorbitan esters, sorbitan esters, glycerol esters, including but not limited to, glycerol monostearate (GMS), and any combination thereof, and (ii) said anionic surfactants are selected from, fatty alcohol ether sulfates, alkyl ether sulfates, special soaps, including but not limited to, anionic long chain fatty acids, and any combination thereof; and (d) one or more microcrystalline or paraffinic waxes comprising saturated hydrocarbon waxes, paraffinic hydrocarbon waxes, isoparaffinic hydrocarbon waxes, naphthenic hydrocarbon waxes, and any mixture thereof, having a congealing point of 50-110° C.; and wherein the amount of said one or more biowax emulsions in the barrier coating composition ranges from 70-90 wt %; and the amount of said one or more polyhydroxyalkanoates (PHA) in the barrier coating composition ranges from 10-30 wt %.

14. The method of claim 13, wherein said at least one biowax emulsion comprises:

(a) said one or more biowaxes in an amount ranging from 20-60 wt %;

(b) said one or more rosin sizing agents in an amount ranging from 1-12 wt %;

(c) said one or more surfactants in an amount ranging from 2-12 wt %; and (d) said one or more microcrystalline or paraffinic waxes in an amount ranging from 2-10wt %;

wherein said at least one biowax emulsion comprises an inverse phase biowax emulsion formed by (i) combining said one or more biowaxes, said one or more rosin sizing agents, said one or more surfactants, and said one or more microcrystalline or paraffinic waxes in a reactor and heating to 70-99° C. to form an oil-phase;

(ii) adding an amount of water to said oil-phase;

(iii) heating to 70-99° C. and then emulsifying;

(iv) homogenizing; and (v) cooling the resulting inverse phase biowax emulsion to a temperature ranging from 10-35° C.

15. The method of claim 12, wherein:

(i) said at least one biowax emulsion, in final form comprises a total solids content ranging from 50-80 wt % and further wherein ≥50 wt % of said total solids content is bio-based;

(ii) said one or more polyhydroxyalkanoates (PHA) comprise an aqueous polyhydroxyalkanoate (PHA) dispersion comprising one or more polyhydroxyalkanoate (PHA) polymers, wherein said aqueous polyhydroxyalkanoate (PHA) dispersion has a total dry solids content ranging from 10-70 wt %;

(iii) said one or more rheology modifiers comprise hydroxypropyl methylcellulose (HPMC), one or more bio-based gums, including but not limited to, pre-hydrated cellulose gums, xanthan gums, or a mixture thereof, one or more bio-based hydrocolloids, one or more polyacrylate dispersants having a charge ranging from 70-100 mol % and a molecular weight ranging from 1000-100,000 Da or a combination thereof;

(iv) said one or more auxiliary additives are selected from clay, kaolin, alumina, silica, nano-clay, nanocellulose, nano-structured cellulose, cellulose nanofibers (CNF), nano-fibrillated cellulose (NFC), bacterial nanocellulose, cellulose nanocrystals (CNC), micro-fibrillated cellulose (MFC), microcrystalline cellulose (MCC), or any combination thereof;

(v) said clay and/or nano-clay is formulated as an aqueous slurry having total solids of 60-80 wt % prior to being dispersed into said barrier coating composition;

(vi) said cellulose nanocrystals (CNC) are formulated as an aqueous slurry or a spray-dried powder prior to being dispersed into said barrier coating composition;

(vii) said micro-fibrillated cellulose (MFC) (i) has an average particle length ranging from 20-200 μm, (ii) has an average particle width ranging from 0.1-1 μm, and (iii) is formulated as an aqueous solution having a dry content of 10-30 wt % prior to formulation with said barrier coating composition;

(viii) said microcrystalline cellulose (MCC) (i) has an average particle size ranging from 1-8 μm, and (ii) is formulated as an aqueous slurry or a spray-dried powder prior to being dispersed into said barrier coating composition; or (ix) anny combination oof (i)-(viii).

16. The method of claim 12, wherein said barrier coating composition comprises:

(a) said at least one biowax emulsion in an amount ranging from 30-90 wt %;

(b) said one or more polyhydroxyalkanoates (PHA) in an amount ranging from 10-70 wt %;

(c) said one or more rheology modifiers in an amount ranging from 0.1-5 wt %; and (d) said one or more auxiliary additives in an amount ranging from 0.1-10 wt %, wherein said at least one biowax emulsion, said one or more rheology modifiers, and said one or more auxiliary additives are dispersed, separately or together, into said one or more polyhydroxyalkanoates (PHA) with mechanical mixing to form said barrier coating composition, wherein, in final form, said barrier coating composition comprises:

(i) a total solids content ranging from 30-70 wt %;

(ii) a bio-based solids content ranging from 40-90 wt % of said total solids content;

(iii) a particle size ranging from 0.2-15 μm; or (iv) any combination of (i) to (iii).

17. The method of claim 12, wherein said barrier coating composition is applied as one or more coatings to a lignocellulosic substrate, including but not limited to paper, paperboard, lightweight wrapping paper basesheets, fast food wrapping paper, molded fibers, or 100% recycled linerboard sheets, wherein said one or more coatings are formed at room temperature, 15-30° C. using a conventional paper coater, rolling-coater, or metering size press machine, followed by oven curing at 100-120° C., and wherein the application of said barrier coating composition to said lignocellulosic substrate results in one or more of the following:

(a) said barrier coating composition forms a single coat layer, a basecoat layer, a topcoat layer, a double-coating comprising a basecoat layer and a topcoat layer comprising the same barrier coating composition, a double-coating comprising a basecoat layer and a topcoat layer comprising different barrier coating compositions, or multiple coating layers;

(b) said one or more coatings provide a barrier to transmittance of one or more of oil, grease, or water, preferably oil and/or grease, into or through said lignocellulosic substrate at temperatures ranging from 5-95° C., wherein said barrier to transmittance is greater than or equal to one or more coatings formed in the same manner from said polyhydroxyalkanoates (PHA) alone;

(c) said one or more coatings applied at a coat weight of 1-30 grams per square meter (gsm), result in KIT test values (i.e., a measure of oil and grease resistance) that are equal to or higher KIT values compared one or more coatings formed in the same manner from said polyhydroxyalkanoates (PHA) alone;

(d) said one or more coatings applied at a coat weight of 1-30 grams per square meter (gsm) result in Cobb 1 min test values (i.e., a measure of mass of water absorbed per square meter over 1 min) that are equal to or lower compared one or more coatings formed in the same manner from said polyhydroxyalkanoates (PHA) alone;

(e) said one or more coatings display a coat weight dependent decrease in Cobb 1 min test results; and (f) said one or more coatings, in final form, comprise a percent bio-based material of 50-80 wt %.

18. A lignocellulosic substrate, including but not limited to paper, paperboard, lightweight wrapping paper basesheets, fast food wrapping paper, molded fibers, or 100% recycled linerboard sheets, comprising one or more coatings of a barrier coating composition according to claim 1.

19. A sheet-like product for use as a food service package, a beverage service package, or any package suitable for the transport and/or storage of materials comprising oil, grease, and/or water, preferably oil and/or grease, comprising:

(a) a substrate comprising lignocellulosic fibers, and having a first parallel large surface and a second parallel large surface, and (b) a coating structure comprising a barrier coating composition according to claim 1 is applied in at least one layer to at least one of the large surfaces of the substrate, wherein said sheet-like product has (i) a KIT test value of 11-12; or (ii) a Cobb 1 min value of less than 6 gsm.

20. A sheet-like product for use as a food service package, a beverage service package, or any package suitable for the transport and/or storage of materials comprising oil, grease, and/or water, preferably oil and/or grease, comprising:

(a) a substrate comprising lignocellulosic fibers, and having a first parallel large surface and a second parallel large surface, and (b) a coating structure comprising a barrier coating composition prepared according to claim 12 is applied in at least one layer to at least one of the large surfaces of the substrate, wherein said sheet-like product has (i) a KIT test value of 11-12; or (ii) a Cobb 1 min value of less than 6 gsm.

* * * * *